US006745975B2

(12) United States Patent
Faulks et al.

(10) Patent No.: US 6,745,975 B2
(45) Date of Patent: Jun. 8, 2004

(54) SYSTEM FOR DISPENSING PLURALITY OF WET WIPES

(75) Inventors: Michael John Faulks, Neenah, WI (US); Yung Hsiang Huang, Appleton, WI (US); William Robert Newman, Neenah, WI (US); Herb F. Velazquez, Neenah, WI (US); Ligia A. Rivera, Appleton, WI (US); Paige Annette Dellerman, Appleton, WI (US); Steven John Romme, Oshkosh, WI (US); Cherry Ann Bochmann, Lakewood, OH (US); Gerald P. DeGreen, Windsor, OH (US); Jeffrey M. Kalman, Cleveland Heights, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 99 days.

(21) Appl. No.: 09/841,323

(22) Filed: Apr. 24, 2001

(65) Prior Publication Data

US 2002/0023932 A1 Feb. 28, 2002

Related U.S. Application Data

(63) Continuation-in-part of application No. 09/660,040, filed on Sep. 12, 2000, which is a continuation-in-part of application No. 09/565,227, filed on May 4, 2000, which is a continuation-in-part of application No. 09/545,995, filed on Apr. 10, 2000.

(60) Provisional application No. 60/132,024, filed on Apr. 30, 1999.

(51) Int. Cl.[7] ..... B65H 16/06; B65H 18/04

(52) U.S. Cl. ..... 242/598.6

(58) Field of Search ..... 242/598.6, 598, 242/598.3, 598.5, 596.8, 579, 580, 580.1, 598.2

(56) References Cited

U.S. PATENT DOCUMENTS

| | | | |
|---|---|---|---|
| 1,664,392 | A | 4/1928 | Baruch |
| 2,440,974 | A | 5/1948 | Resch |
| 3,310,353 | A | 3/1967 | Cordis |
| 3,368,522 | A | 2/1968 | Cordis |
| 3,532,210 | A | 10/1970 | Minion et al. |

(List continued on next page.)

FOREIGN PATENT DOCUMENTS

| | | |
|---|---|---|
| EP | 0 020 083 A1 | 12/1980 |
| EP | 0 110 473 A1 | 6/1984 |

(List continued on next page.)

OTHER PUBLICATIONS

Derwent World Patent Database Abstract of DE 3133237: Description of M. Scheepe, "Refill Pack of Moisture–Impregnated Tissues".

(List continued on next page.)

*Primary Examiner*—Emmanuel Marcelo
(74) *Attorney, Agent, or Firm*—Michael J. Bendel; Scott A. Baum

(57) ABSTRACT

There is provided a system for dispensing a plurality of perforated wipes having a perforation detach strength characteristic. The system includes a dispenser having a dispensing force characteristic and including a sealable chamber. The chamber is configured to retain the plurality of perforated wipes therein. A dispensing opening is in communication with the chamber. The opening is adapted to dispense wipes from the plurality of perforated wipes through the opening and out of the dispenser. A wiper blade is positioned in the dispenser to engage at least a portion of the wipes as the wipes dispense through the opening. When dispensing, a ratio of the perforation detach strength characteristic to the dispensing force characteristic is greater than 1:1.

26 Claims, 16 Drawing Sheets

U.S. PATENT DOCUMENTS

| | | | |
|---|---|---|---|
| 3,568,635 | A | 3/1971 | Poitras et al. |
| 3,592,161 | A | 7/1971 | Hoffmann |
| 3,603,519 | A | 9/1971 | Brown et al. |
| 3,633,838 | A | 1/1972 | Krueger |
| 3,656,699 | A | 4/1972 | Schnyder et al. |
| 3,713,170 | A | 1/1973 | Kaufman |
| 3,729,145 | A | 4/1973 | Koo et al. |
| 3,754,804 | A | 8/1973 | Cushman |
| 3,756,483 | A | 9/1973 | Schraeder |
| 3,771,399 | A | 11/1973 | Aterianus |
| 3,771,739 | A | 11/1973 | Nelson |
| 3,775,801 | A | 12/1973 | Walker |
| 3,780,908 | A | 12/1973 | Fitzpatrick et al. |
| 3,784,055 | A | 1/1974 | Anderson |
| 3,788,573 | A | 1/1974 | Thomson et al. |
| D230,805 | S | 3/1974 | Howard |
| 3,795,355 | A | 3/1974 | Gerstein |
| 3,806,055 | A | 4/1974 | Bauman |
| 3,824,953 | A | 7/1974 | Boone |
| 3,836,044 | A | 9/1974 | Tilp |
| 3,836,045 | A | 9/1974 | Duhy et al. |
| 3,837,595 | A | 9/1974 | Boone |
| 3,841,466 | A | 10/1974 | Hoffman et al. |
| 3,843,017 | A | 10/1974 | Harrison |
| 3,848,822 | A | 11/1974 | Boone |
| 3,865,271 | A | 2/1975 | Gold |
| 3,868,052 | A | 2/1975 | Rockefeller |
| 3,890,622 | A | 6/1975 | Alden |
| 3,913,522 | A | 10/1975 | Light |
| 3,943,859 | A | 3/1976 | Boone |
| 3,949,947 | A | 4/1976 | Youngquist et al. |
| 3,967,756 | A | 7/1976 | Barish |
| 3,970,215 | A | 7/1976 | McLaren et al. |
| 3,973,695 | A | 8/1976 | Ames |
| 3,982,659 | A | 9/1976 | Ross |
| 3,986,479 | A | 10/1976 | Bonk |
| 3,994,417 | A | 11/1976 | Boedecker |
| 3,995,582 | A | 12/1976 | Douglas |
| 4,002,264 | A | 1/1977 | Marchesani |
| 4,004,687 | A | 1/1977 | Boone |
| 4,025,004 | A | 5/1977 | Massey |
| 4,043,519 | A | 8/1977 | Suzuki et al. |
| 4,069,789 | A | 1/1978 | Fukagawa et al. |
| 4,071,200 | A | 1/1978 | Stone |
| D247,465 | S | 3/1978 | Ford |
| 4,098,469 | A | 7/1978 | McCarthy |
| 4,101,026 | A | 7/1978 | Bonk |
| 4,106,433 | A | 8/1978 | Fernando et al. |
| 4,106,616 | A | 8/1978 | Boone |
| 4,106,617 | A | 8/1978 | Boone |
| 4,114,824 | A | 9/1978 | Danielak |
| 4,124,259 | A | 11/1978 | Harris |
| 4,131,195 | A | 12/1978 | Worrell, Sr. |
| 4,135,199 | A | 1/1979 | Kurland et al. |
| 4,135,678 | A | 1/1979 | Williams |
| 4,138,034 | A | 2/1979 | McCarthy |
| 4,179,078 | A | 12/1979 | Mansfield |
| 4,191,317 | A | 3/1980 | Harkins |
| 4,205,802 | A | 6/1980 | Economakis |
| D256,062 | S | 7/1980 | Joachim et al. |
| 4,219,129 | A | 8/1980 | Sedgwick |
| 4,222,621 | A | 9/1980 | Greenlee et al. |
| 4,235,333 | A | 11/1980 | Boone |
| 4,238,541 | A | 12/1980 | Burton |
| 4,244,493 | A | 1/1981 | Harrison |
| 4,260,117 | A | 4/1981 | Perrin et al. |
| 4,272,473 | A | 6/1981 | Riemersma et al. |
| 4,274,573 | A | 6/1981 | Finkelstein |
| 4,280,978 | A | 7/1981 | Dannheim et al. |
| 4,294,389 | A | 10/1981 | Falk et al. |
| 4,328,907 | A | 5/1982 | Beard |
| 4,353,480 | A | 10/1982 | McFadyen |
| 4,363,454 | A | 12/1982 | Mohar |
| 4,375,874 | A | 3/1983 | Leotta et al. |
| 4,383,656 | A | 5/1983 | Campbell |
| 4,401,248 | A | 8/1983 | Helms |
| 4,411,374 | A | 10/1983 | Hotchkiss |
| 4,425,012 | A | 1/1984 | Kley |
| 4,427,159 | A | 1/1984 | Miller et al. |
| 4,428,497 | A | 1/1984 | Julius et al. |
| 4,432,504 | A | 2/1984 | Pace |
| 4,436,221 | A | 3/1984 | Margulies |
| 4,447,015 | A | 5/1984 | Peterson |
| 4,453,634 | A | 6/1984 | Blumenthal |
| 4,463,912 | A | 8/1984 | Grunerud |
| 4,467,974 | A | 8/1984 | Crim |
| 4,526,291 | A | 7/1985 | Margulies |
| 4,535,912 | A | 8/1985 | Bonk |
| 4,550,855 | A | 11/1985 | Harrison |
| 4,564,148 | A | 1/1986 | Wentworth |
| 4,566,606 | A | 1/1986 | Kling |
| 4,570,820 | A | 2/1986 | Murphy |
| 4,607,809 | A | 8/1986 | Sineni et al. |
| 4,648,530 | A | 3/1987 | Granger |
| 4,659,028 | A | 4/1987 | Wren |
| 4,662,576 | A | 5/1987 | Paul |
| 4,662,577 | A | 5/1987 | Lewis |
| 4,667,890 | A | 5/1987 | Gietman, Jr. |
| 4,684,075 | A | 8/1987 | Francis |
| 4,687,153 | A | 8/1987 | McNeil |
| 4,690,345 | A | 9/1987 | Cotey |
| 4,721,264 | A | 1/1988 | Muscarello |
| 4,735,317 | A | 4/1988 | Sussman et al. |
| 4,756,485 | A | 7/1988 | Bastian et al. |
| 4,784,290 | A | 11/1988 | Howard |
| 4,790,490 | A | 12/1988 | Chakravorty |
| 4,807,823 | A | 2/1989 | Wyant |
| 4,826,063 | A | 5/1989 | Ban |
| 4,828,193 | A | 5/1989 | Galbraith |
| 4,830,301 | A | 5/1989 | Miller |
| 4,834,316 | A | 5/1989 | DeLorean |
| 4,836,368 | A | 6/1989 | Cotton |
| 4,836,462 | A | 6/1989 | Bruss |
| 4,846,412 | A | 7/1989 | Morand |
| 4,860,893 | A | 8/1989 | Kaufman |
| D303,890 | S | 10/1989 | Pilot |
| 4,877,133 | A | 10/1989 | Klenter et al. |
| 4,883,197 | A | 11/1989 | Sanchez et al. |
| 4,884,690 | A | 12/1989 | Klenter et al. |
| 4,890,205 | A | 12/1989 | Shaffer |
| 4,913,365 | A | 4/1990 | Shamass |
| 4,936,452 | A | 6/1990 | Pauley |
| D311,106 | S | 10/1990 | Jaber |
| 4,978,095 | A | 12/1990 | Phillips |
| 4,984,530 | A | 1/1991 | Dutton |
| 4,989,800 | A | 2/1991 | Tritch |
| 4,991,538 | A | 2/1991 | Davids et al. |
| 5,000,393 | A | 3/1991 | Madsen |
| 5,001,956 | A | 3/1991 | Nitsch |
| 5,009,313 | A | 4/1991 | Morand |
| D316,787 | S | 5/1991 | Kelly |
| 5,012,986 | A | 5/1991 | Needle |
| 5,029,787 | A | 7/1991 | Florentin |
| 5,050,737 | A | 9/1991 | Joslyn et al. |
| 5,054,676 | A | 10/1991 | Ban |
| 5,104,054 | A | 4/1992 | Latham |
| 5,114,771 | A | 5/1992 | Ogg et al. |
| 5,137,173 | A | 8/1992 | Hughes et al. |
| 5,141,171 | A | 8/1992 | Yang |
| 5,145,091 | A | 9/1992 | Meyers |
| D329,978 | S | 10/1992 | Ryan |

5,154,496 A 10/1992 Campbell et al.
5,170,958 A 12/1992 Brown
5,172,840 A 12/1992 Bloch et al.
D332,875 S 2/1993 Shufelt et al.
5,192,044 A 3/1993 Baskin
5,193,759 A 3/1993 Bigelow et al.
5,195,689 A 3/1993 Beer et al.
5,207,367 A 5/1993 Dunn et al.
5,219,092 A 6/1993 Morand
5,228,632 A 7/1993 Addison et al.
D339,262 S 9/1993 McClure
5,253,818 A 10/1993 Craddock
5,255,800 A 10/1993 Kelly
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
5,312,883 A 5/1994 Komatsu et al.
5,317,063 A 5/1994 Komatsu et al.
D347,534 S 6/1994 Gottselig
5,335,811 A 8/1994 Morand
5,368,157 A 11/1994 Gasparrini et al.
D353,053 S 12/1994 Arnone
5,370,336 A 12/1994 Whittington
5,374,008 A 12/1994 Halvorson et al.
5,384,189 A 1/1995 Kuroda et al.
5,392,945 A 2/1995 Syrek
5,400,982 A 3/1995 Collins
5,409,181 A 4/1995 Patrick
5,439,521 A * 8/1995 Rao ..... 118/415
5,443,084 A 8/1995 Saleur
D361,895 S 9/1995 Arnone et al.
D362,121 S 9/1995 Nugent et al.
5,449,127 A 9/1995 Davis
D362,773 S 10/1995 Kartchner
5,456,420 A 10/1995 Frazier
5,456,421 A 10/1995 Reed
5,464,096 A 11/1995 Hurwitz
5,464,170 A 11/1995 Mitchell et al.
5,480,060 A 1/1996 Blythe
5,494,250 A 2/1996 Chen
5,495,997 A 3/1996 Moody
5,501,323 A 3/1996 Denesha et al.
5,509,593 A 4/1996 Bloch et al.
5,520,308 A 5/1996 Berg, Jr. et al.
5,526,973 A 6/1996 Boone et al.
5,533,621 A 7/1996 Schoal, Jr.
5,540,332 A 7/1996 Kopacz et al.
5,542,568 A 8/1996 Julius
D373,276 S 9/1996 Omdoll et al.
5,560,514 A 10/1996 Frazier
5,562,964 A 10/1996 Jones
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,609,269 A 3/1997 Behnke et al.
5,618,008 A 4/1997 Dearwester et al.
5,620,148 A 4/1997 Mitchell
5,624,025 A 4/1997 Hixon
5,630,526 A 5/1997 Moody
5,630,563 A 5/1997 Meisner et al.
5,631,317 A 5/1997 Komatsu et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A 8/1997 Newbold
5,660,636 A 8/1997 Shangold et al.
D383,310 S 9/1997 Springer
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A 12/1997 Ogden
5,704,565 A 1/1998 Cheng
5,704,566 A 1/1998 Schutz et al.
5,727,458 A 3/1998 Schulz
5,755,654 A 5/1998 Schulz et al.
5,765,717 A 6/1998 Gottselig
D397,265 S 8/1998 Badillo
5,839,688 A 11/1998 Hertel et al.
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,875,985 A 3/1999 Cohen et al.
5,887,759 A 3/1999 Ayigbe
5,887,818 A 3/1999 Kelley
5,893,531 A 4/1999 Taylor et al.
5,897,074 A 4/1999 Marino
5,901,921 A 5/1999 Perlsweig
5,904,316 A 5/1999 Dunning et al.
5,914,177 A 6/1999 Smith, III et al.
5,924,617 A 7/1999 LaCount et al.
D412,439 S 8/1999 Cormack
5,938,013 A 8/1999 Palumbo et al.
5,950,960 A 9/1999 Marino
5,951,762 A 9/1999 Shangold et al.
5,958,187 A 9/1999 Bhat et al.
5,964,351 A 10/1999 Zander
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
5,992,718 A 11/1999 Zaranek
D417,987 S 12/1999 Velazquez
6,000,538 A 12/1999 Lee
6,000,658 A 12/1999 McCall, Jr.
6,007,019 A 12/1999 Lynch
6,010,001 A 1/2000 Osborn, III
6,015,125 A 1/2000 Fischer
6,024,216 A 2/2000 Shillington et al.
6,024,217 A 2/2000 Ponsi et al.
6,024,323 A 2/2000 Palerno, Jr.
6,029,921 A 2/2000 Johnson
D421,691 S 3/2000 Hoblitz
6,036,134 A 3/2000 Moody
D422,437 S 4/2000 Conran et al.
6,047,920 A 4/2000 Dearwester et al.
6,056,233 A 5/2000 Von Schenk
6,056,235 A 5/2000 Brozinsky
6,059,882 A 5/2000 Steinhardt et al.
6,059,928 A 5/2000 Van Luu et al.
6,068,118 A 5/2000 Calloway
6,070,821 A 6/2000 Mitchell
6,079,603 A 6/2000 Smegal
6,082,664 A 7/2000 Phelps et al.
6,085,899 A 7/2000 Thorsbakken
6,092,690 A 7/2000 Bitowft et al.

| | | | |
|---|---|---|---|
| 6,092,758 | A | 7/2000 | Gemmell |
| 6,092,759 | A | 7/2000 | Gemmell et al. |
| D429,282 | S | 8/2000 | Velazquez et al. |
| 6,098,836 | A | 8/2000 | Gottselig |
| 6,121,165 | A | 9/2000 | Mackey et al. |
| 6,138,867 | A | 10/2000 | Stelmack |
| 6,138,939 | A | 10/2000 | Phelps et al. |
| 6,158,614 | A | 12/2000 | Haines et al. |
| 6,228,454 | B1 | 5/2001 | Johnson et al. |
| 6,273,359 | B1 | 8/2001 | Newman et al. |

FOREIGN PATENT DOCUMENTS

| | | | |
|---|---|---|---|
| EP | 0 122 809 | A1 | 10/1984 |
| EP | 0 251 103 | B1 | 2/1990 |
| EP | 0 501 905 | A1 | 9/1992 |
| EP | 0 796 728 | A2 | 9/1997 |
| EP | 0 608 460 | B1 | 9/1998 |
| EP | 0 895 956 | A1 | 2/1999 |
| EP | 1 048 257 | A1 | 11/2000 |
| GB | 990332 | | 4/1965 |
| GB | 1 324 818 | | 7/1973 |
| GB | 2 308 114 | A | 6/1997 |
| WO | WO 93/17933 | A1 | 9/1993 |
| WO | WO 96/21388 | A1 | 7/1996 |
| WO | WO 98/08763 | A1 | 3/1998 |
| WO | WO 99/01536 | A1 | 1/1999 |
| WO | WO 99/06311 | A2 | 2/1999 |
| WO | WO 00/00071 | A1 | 1/2000 |
| WO | WO 00/08998 | A1 | 2/2000 |
| WO | WO 00/38751 | A1 | 7/2000 |
| WO | WO 00/65973 | A1 | 10/2000 |

OTHER PUBLICATIONS

Derwent World Patent Database abstract of JP 07–284,461 A: Description of Kusunoki N (KUSU–I), "Toilet Paper Holder", and Patent Abstracts of Japan JP 07–284,461: Description of Kusunoki Nobuaki, "Toilet Paper–Holder Allowing Taking Out Paper Thereof With One Hand".

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder".

Kotler, Philip, *Marketing Management*, Prentice Hall, Upper Saddle River, NJ, 2000, pp. 456–483.

Images of Moist Mates product—dispenser and wipes, approximately 1996, 15 Pages.

Images of Moist Mates product—dispenser and wipes, approximately 2000, 13 Pages.

Images of Moist Mates product—refill wipes, approximately 2000, 11 Pages.

Images of Fresh & Clean product—wet toilet paper, approximately Sep. 2000, 3 Pages.

Gottselig, Letter, dated Apr. 4, 1998, and accompanying drawings.

American Society for Testing Materials (ASTM) Designation: D 395–95, "Standard Test Methods for U–Bend Seanless Copper and Copper Alloy Heat Exchanger and Condenser Tubes", pp. 535–543, published Oct. 1995.

American Society for Testing Materials (ASTM) Designation: D 1117–80, "Standard Test Methods of Testing Nonwoven Fabrics," pp. 240–246, published May 1980.

American Society for Testing Materials (ASTM) Designation: D 2240–97, "Standard Test Method for Rubber Property—Durometer Hardness," pp. 400–403, published Mar. 1997.

American Society for Testing Materials (ASTM) Designation: D 412–98a, "Standard Test Methods for Vulcanized Rubber and Thermoplastic Elastomers—Tension," pp. 43–55, published Aug. 1988.

American Society for Testing Materials (ASTM) Designation: D 6125–97, "Standard Test Method for Bending Resistance of Paper and Paperboard (Gurley Type Tester)," pp. 885–889, published Feb. 1998.

American Society for Testing Materials (ASTM) Designation: D 624–98, "Standard Test Methods for Tear Strength of Conventional Vulcanized Rubber and Thermoplastic Elastomers", pp. 132–140, published Apr. 1998.

American Society for Testing Materials (ASTM) Designation: D 790–99, "Standard Test Methods for Flexural Properties of Unreinforced and Reinforced Plastics and Electrical Insulating Materials", pp. 150–158, published Feb. 2000.

American Society for Testing Materials (ASTM) Designation: D 792–98, "Standard Test Methods for Density and Specific Gravity (Relative Density) of Plastics by Displacement", pp. 159–163, published Nov. 1998.

* cited by examiner

SYSTEM FOR DISPENSING PLURALITY OF WET WIPES

This application is a continuation in part of pending U.S. application entitled "ROLL OF WET WIPES," Ser. No. 09/660,040 filed Sep. 12, 2000, which is a continuation in part of pending U.S. application entitled "SYSTEM AND DISPENSER FOR DISPENSING WET WIPES," Ser. No. 09/565,227, filed May 4, 2000, which is a continuation in part of pending U.S. application entitled This application also claims the benefit of provisional 60/132,024 filed on Apr. 30, 1999. "DISPENSER FOR PREMOISTENED WIPES," Ser. No. 09/545,995, filed on Apr. 10, 2000.

BACKGROUND OF THE INVENTION

Wet products such as wet wipes have many applications. They may be used with small children and infants when changing diapers, they may be used for household cleaning tasks, they may be used for cleaning hands, they may be used as a bath tissue, they may be used as by a caregiver to clean a disabled or incontinent adult, or they may be used in and for a whole host of other applications, where it is advantageous to have a wipe or towel that has some wetness or moisture in it.

Wet wipes have been traditionally dispensed in sheet form from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed.

Wet wipes can be any wipe, towel, tissue or sheet like product including natural fibers, synthetic fibers, synthetic material and combinations thereof, that is wet or moist or becomes wet prior to use. Wet wipes may be dispersible when in contact with water or may be non-dispersible. Examples of wet wipes are disclosed in application Ser. Nos. 09/564,449; 09/564,213; 09/565,125; 09/564,837; 09/564,939; 09/564,531; 09/564,268; 09/564,424; 09/564,780; 09/564,212; 09/565,623 all filed May 4, 2000, and application Ser. No. 09/223,999 entitled Ion-Sensitive Hard Water Dispersible Polymers And Applications Therefore, filed Dec. 31, 1998, the disclosures of which are incorporated herein by reference. Embodiments of dispensers are described in U.S. application Ser. No. 09/659,307, entitled "WET WIPES" filed Sep. 12, 2000, the disclosure of which is incorporated herein by reference.

SUMMARY OF THE INVENTION

The dispensing of a plurality of wet wipes, and particularly a perforated roll, works better if particular dispensing characteristics are present. For example, this can be due, at least in part, to the physical properties of the plurality of wipes. As another example, this can be due, at least in part, to the dispenser container from which the wipes are dispensed and properties thereof.

In response to a desire to enhance the dispensing of a plurality of wipes, for example, particular dispensing characteristics have been discovered and quantified. The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In an aspect of the invention, there is provided a system for dispensing a plurality of perforated wipes, the plurality of perforated wipes having a perforation detach strength characteristic. The system includes a dispenser having a dispensing force characteristic and including a sealable chamber and the chamber is configured to retain the plurality of perforated wipes therein. A dispensing opening is in communication with the chamber and the opening is adapted to dispense wipes from the plurality of perforated wipes through the opening and out of the dispenser. A wiper blade is positioned in the dispenser to engage at least a portion of the wipes as the wipes dispense through the opening. When dispensing, then, a ratio of the perforation detach strength characteristic to the dispensing force characteristic is greater than 1:1.

In another aspect of the invention, there is provided a system for dispensing a plurality of perforated wipes, the plurality of perforated wipes having a perforation detach strength characteristic. The system includes a dispenser having a dispensing force characteristic and including a sealable chamber and the chamber configured to retain the plurality of perforated wipes therein. A dispensing opening is in communication with the chamber and the opening is adapted to dispense wipes from the plurality of perforated wipes through the opening and out of the dispenser. A wiper blade is positioned in the dispenser to engage at least a portion of the wipes as the wipes dispense through the opening. When dispensing, the dispensing force characteristic is greater than 0 g/cm and less than about 75 g/cm.

In yet another aspect of the invention, there is provided a roll of wipes dispensing system. The system includes a roll of perforated wipes having a perforation detach strength characteristic. The system further includes a dispenser having a dispensing force characteristic and including a sealable chamber. The roll of perforated wipes is retained within the chamber. A dispensing opening is in communication with the chamber, the opening adapted to dispense wipes from the roll of perforated wipes through the opening and out of the dispenser. A resilient wiper blade is positioned in the dispenser to engage at least a portion of the wipes as the wipes dispense through the opening. During dispensing, a ratio of the perforation detach strength characteristic to the dispensing force characteristic is greater than 1:1.

In still another aspect of the invention, there is provided a roll of wipes for use in a dispensing system. The roll of wipes includes a roll of perforated wipes having a perforation detach strength characteristic. The perforation detach strength characteristic is greater than 55 g/cm.

In still other aspects of the invention, there are provided desired and more desired ranges relating to characteristics of wipes and of dispenser and relating to particular structures of the dispenser.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

Figure 1:
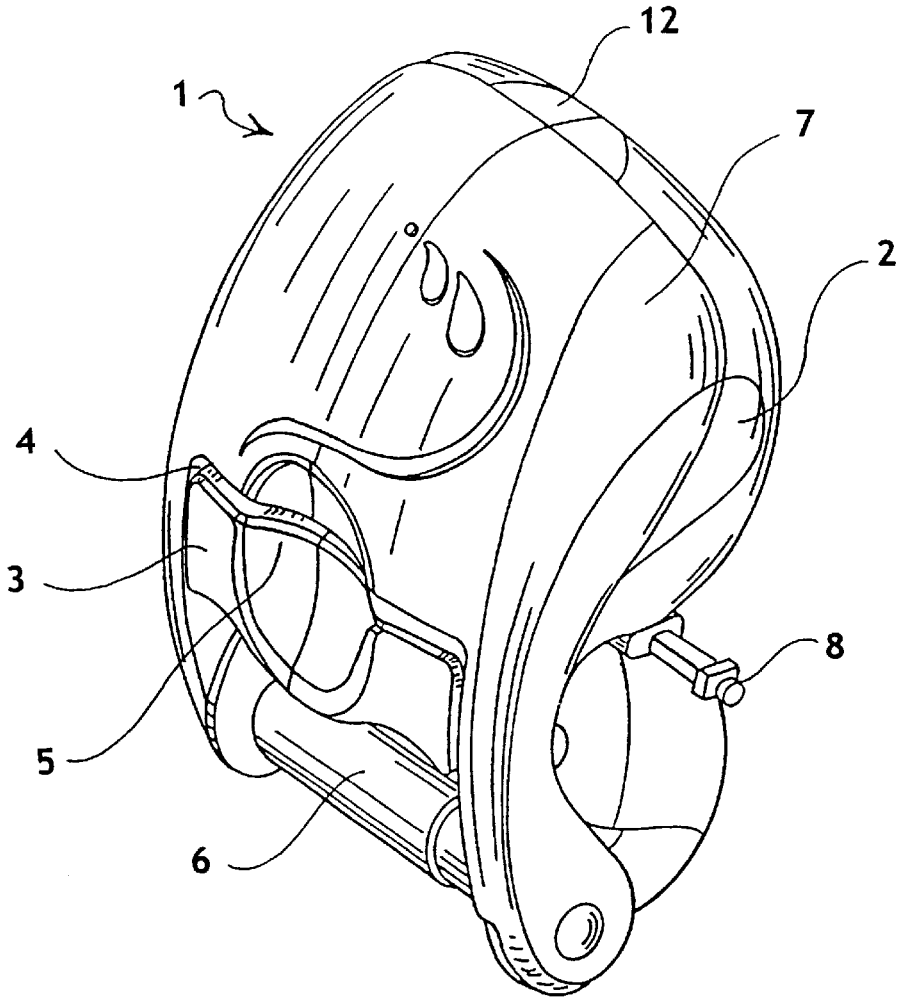
FIG. 1 is a perspective view of a dispenser.
Figure 2A:
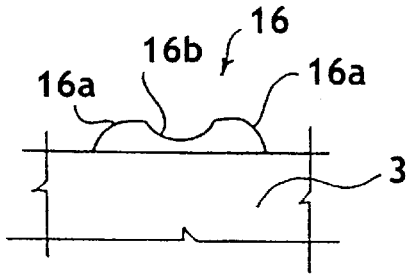
FIG. 2 is an exploded view of the dispenser of FIG. 1.

FIG. 2*a* is a plan view of a portion of the front of a tray of the dispenser of FIG. 1.

Figure 3:
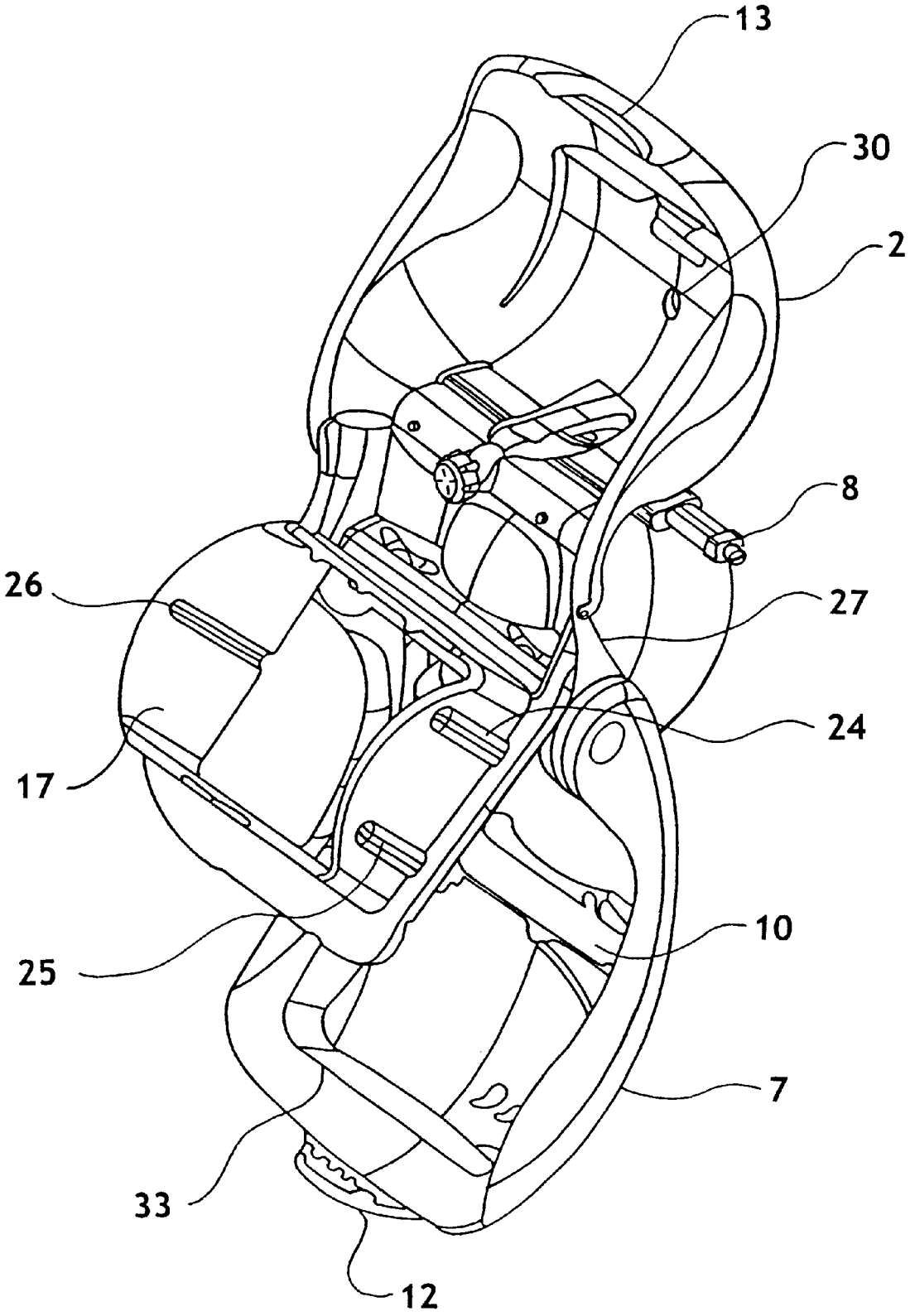

FIG. 3 is a perspective view of the dispenser of FIG. 1, in an open position.

Figure 4:
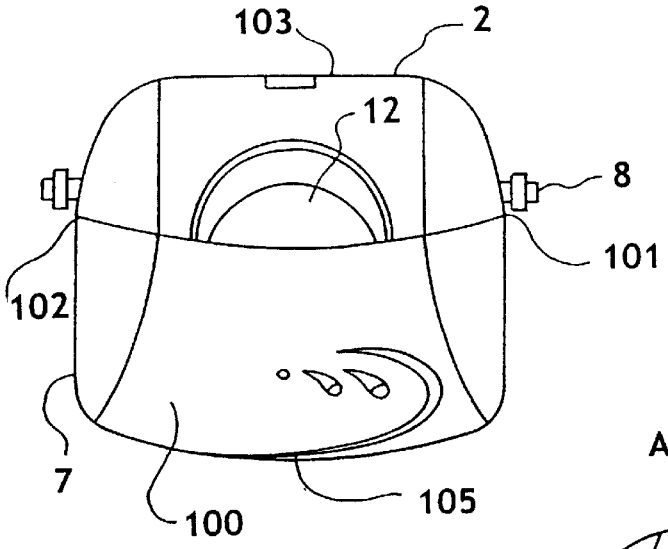

FIG. 4 is a top view of the dispenser of FIG. 1.

Figure 4A:
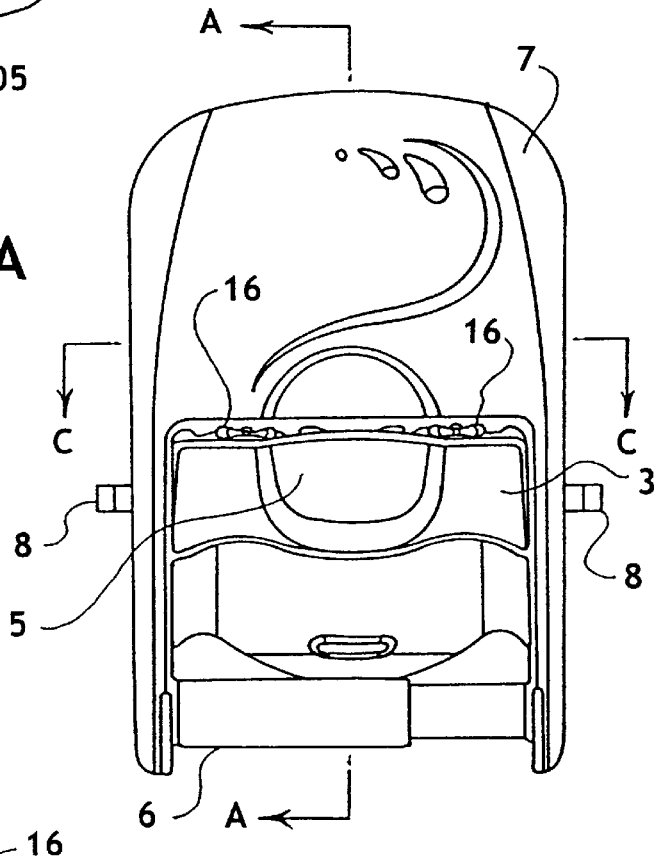

FIG. 4A is a front view of the dispenser of FIG. 1

Figure 4B:
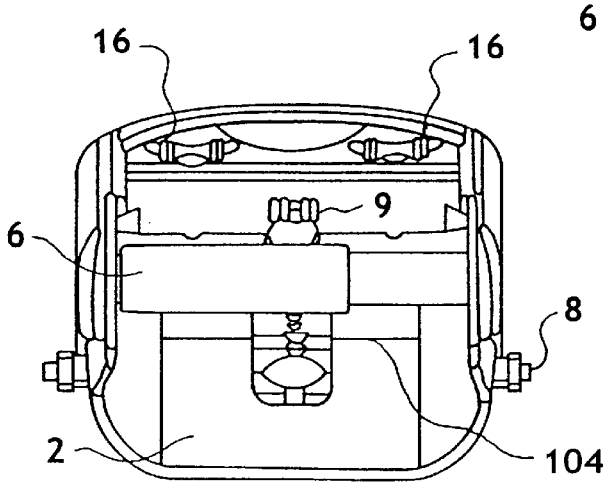

FIG. 4B is a bottom view of the dispenser of FIG. 1.

Figure 2:
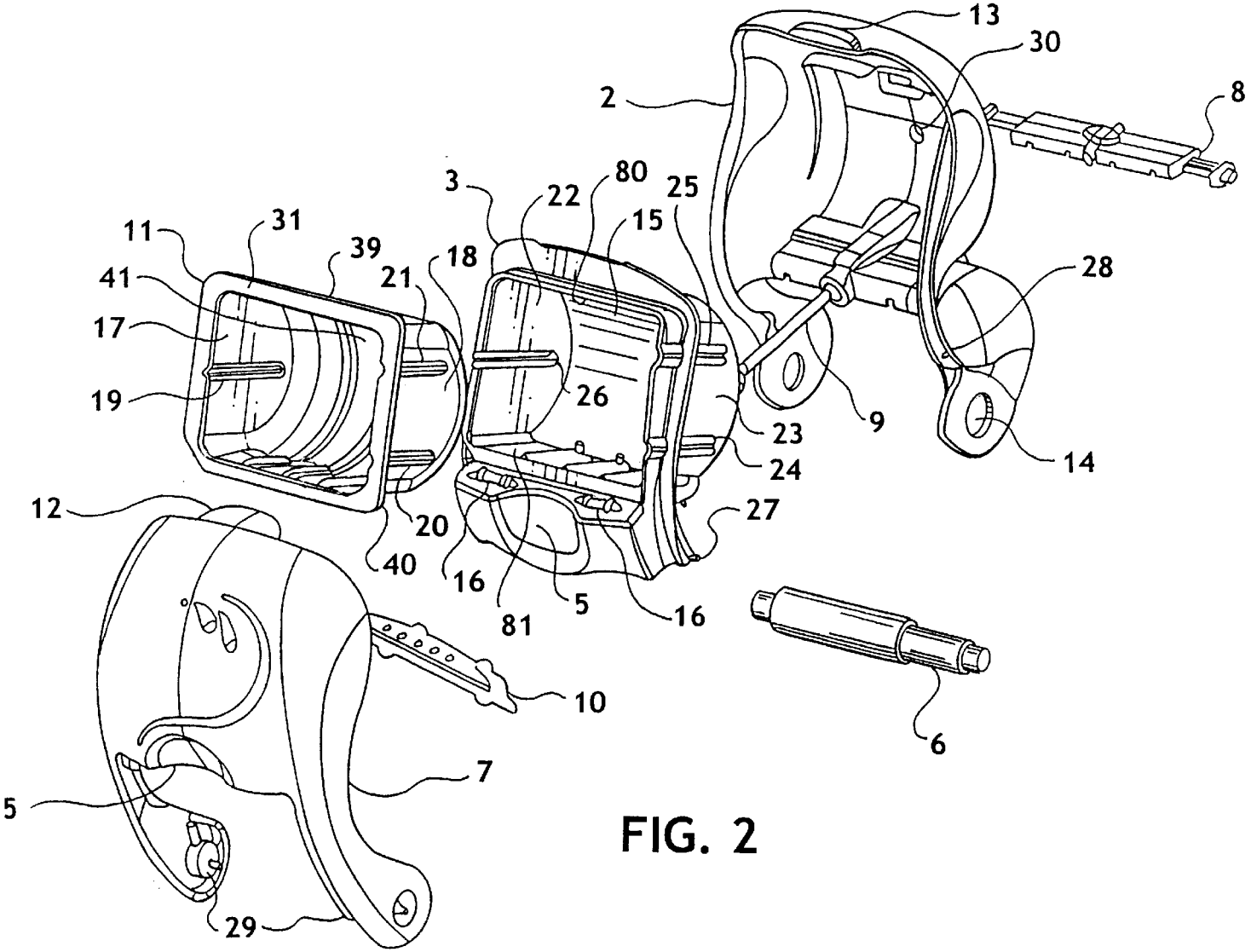
Figure 5:
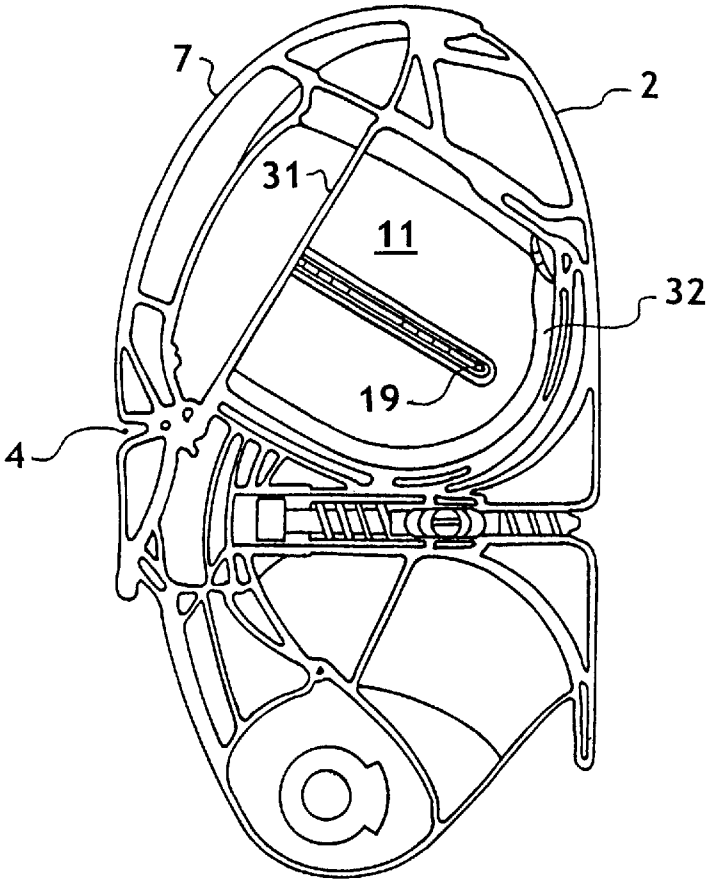

FIG. 5 is a cross-sectional view of the dispenser and cartridge of FIG. 2 taken along line A—A of FIG. 4A.

Figure 6:
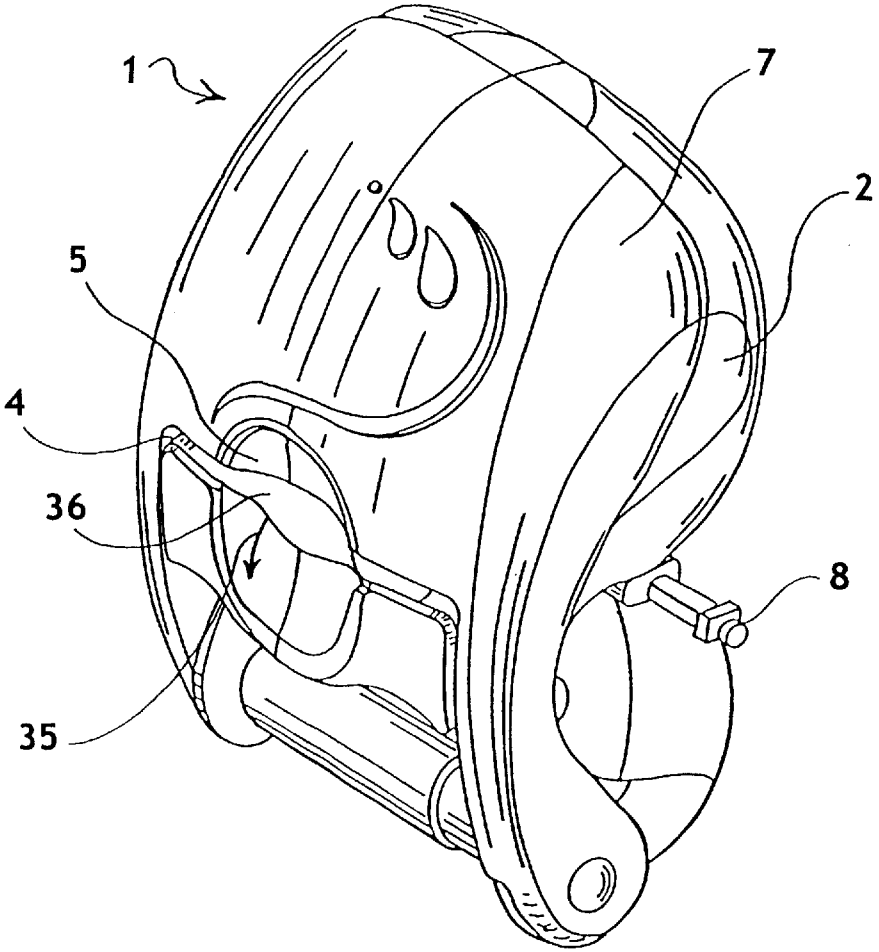

FIG. 6 is a perspective view of the dispenser of FIG. 1, with a wet wipe partial projecting out of the dispenser gap.

Figure 7:
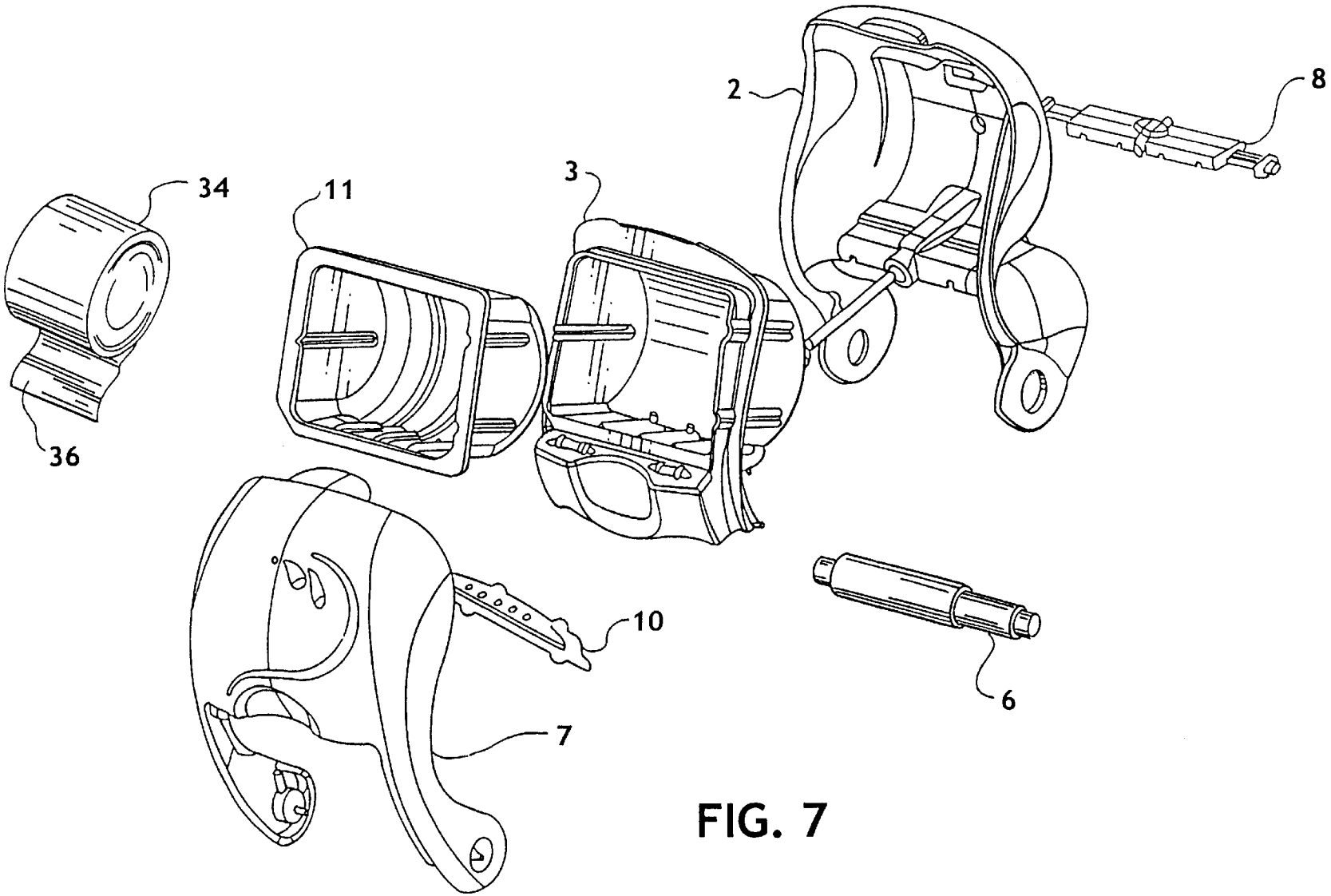

FIG. 7 is a perspective view of a dispenser, with a cartridge and a roll of wet wipes.

Figure 8:
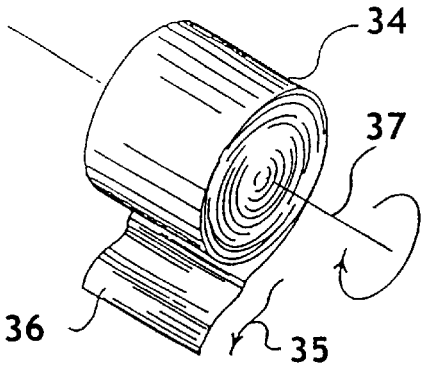

FIG. 8 is a perspective view of a roll of wet wipes

Figure 9:
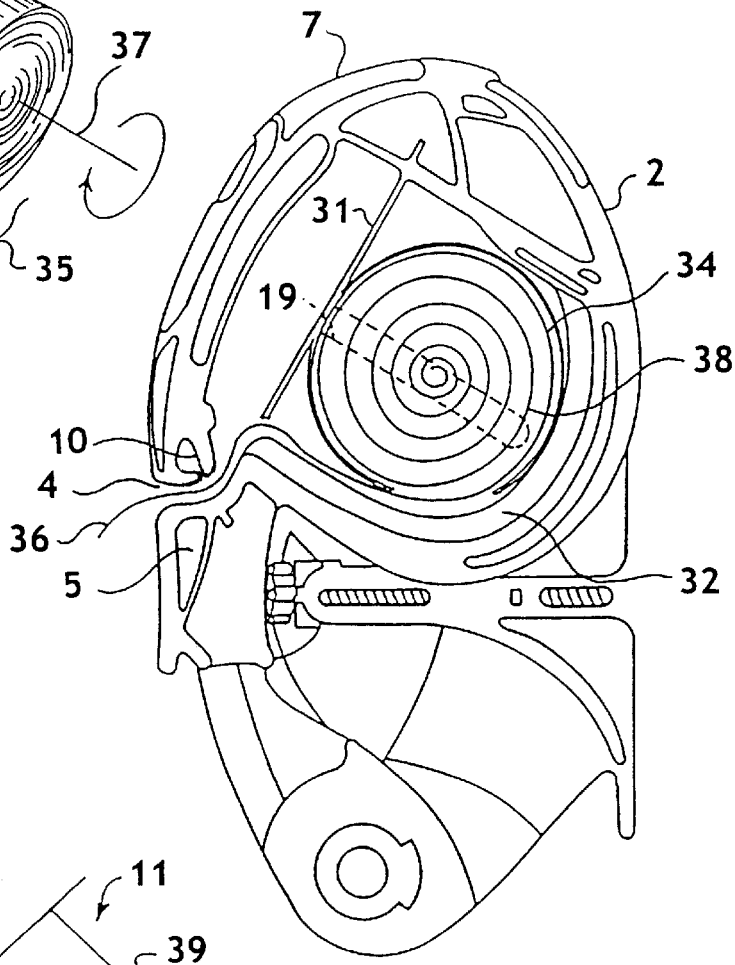

FIG. 9 is a cross-sectional view of the dispenser of FIG. 7, with the cartridge and roll of wet wipes position therein.

Figure 10:
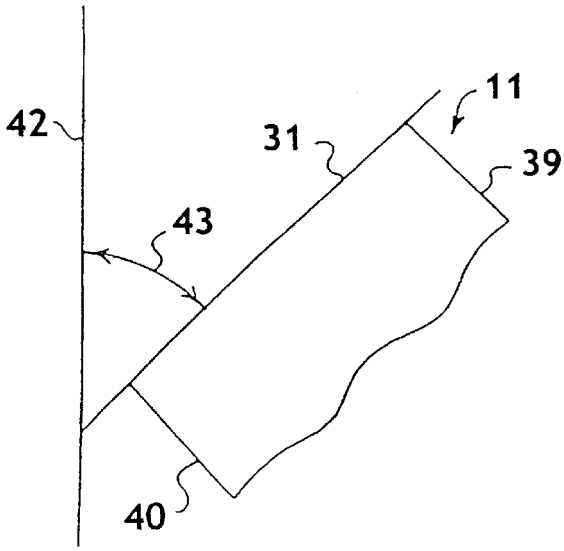

FIG. 10 is a cross-sectional view of a portion of a cartridge.

Figure 11:
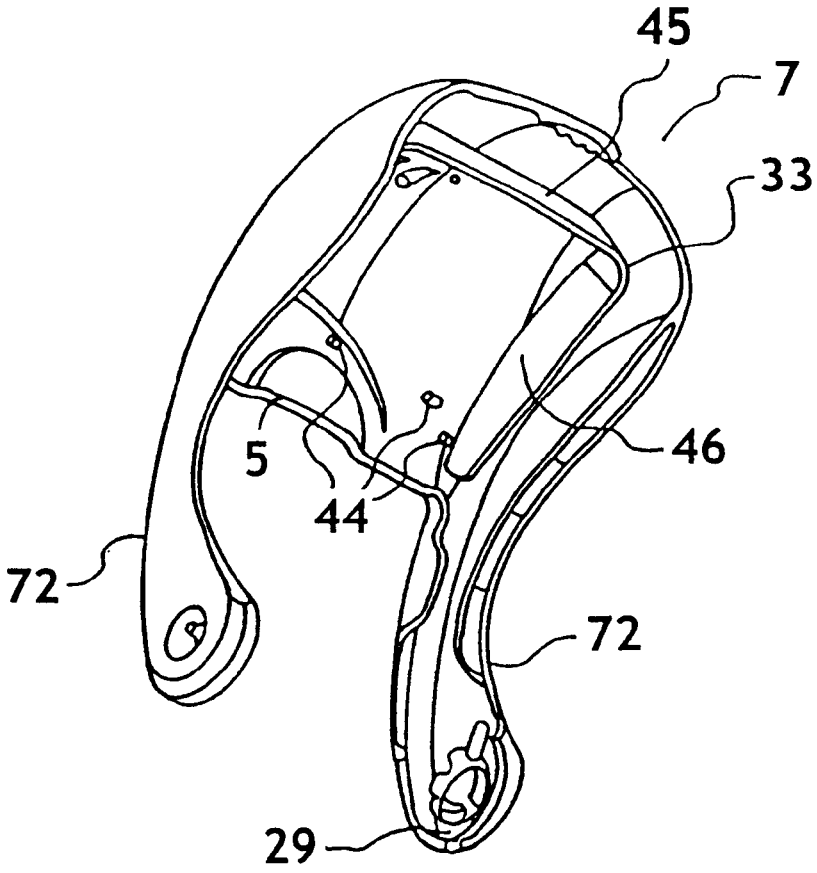
Figure 13:
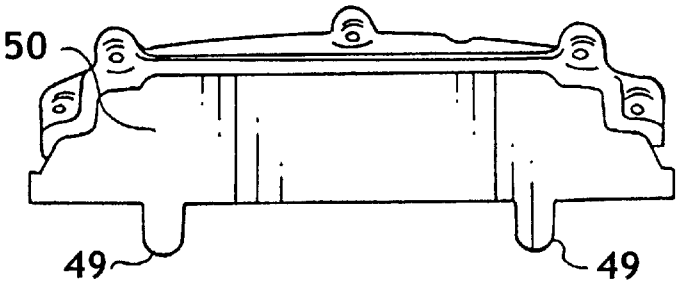
Figure 16:
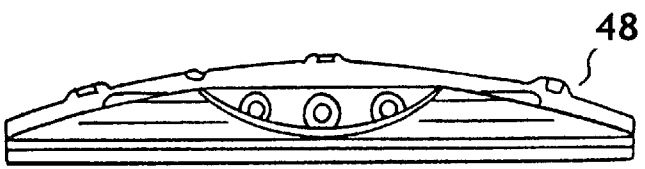

FIG. 11 is a perspective view of the inside of a cover for use with the dispenser.

FIGS. 12–16 are views of a wiper assembly.

Figure 12:
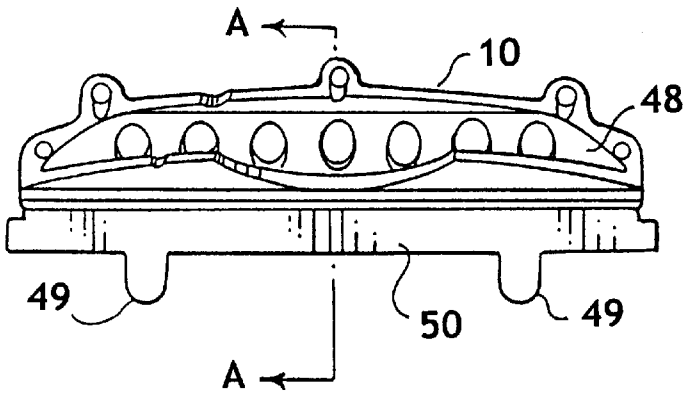
Figure 12A:
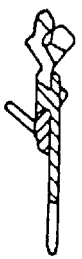

FIG. 12A is a view along line A—A of FIG. 12.

Figure 14:
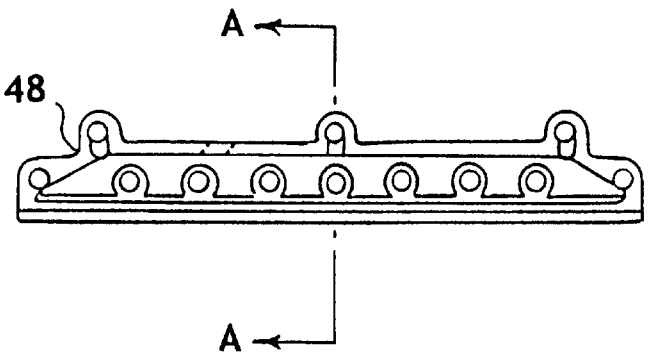
Figure 15:
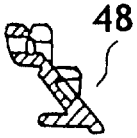

FIG. 15 is a view along line A—A of FIG. 14.

Figure 17:
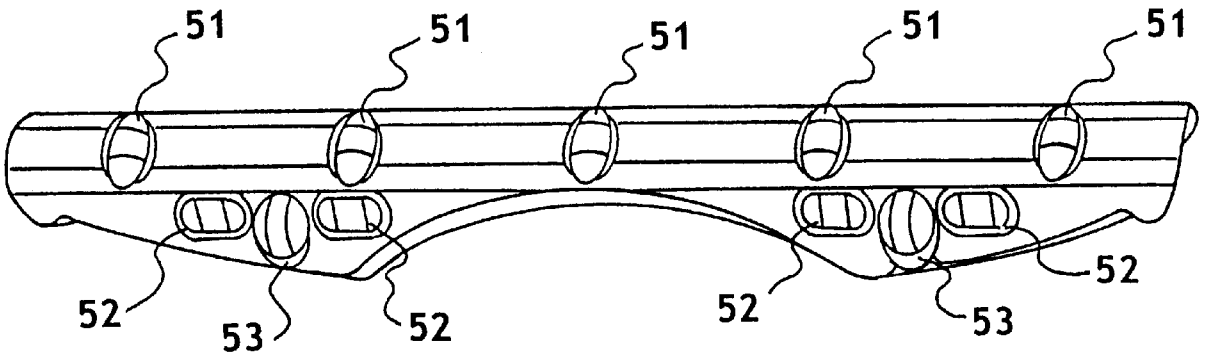
Figure 18:
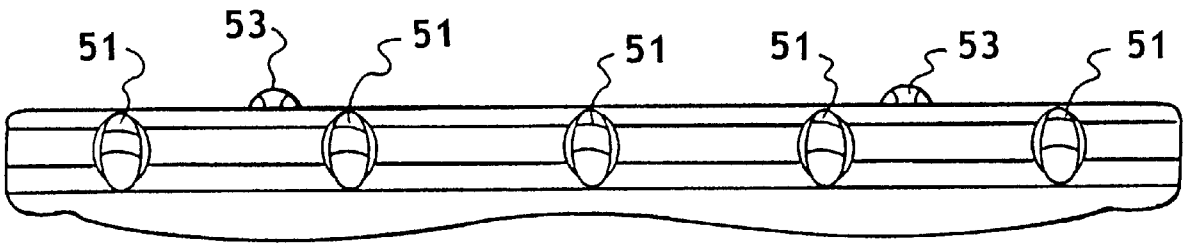

FIGS. 17–18 are views of a wiper.

Figure 19:
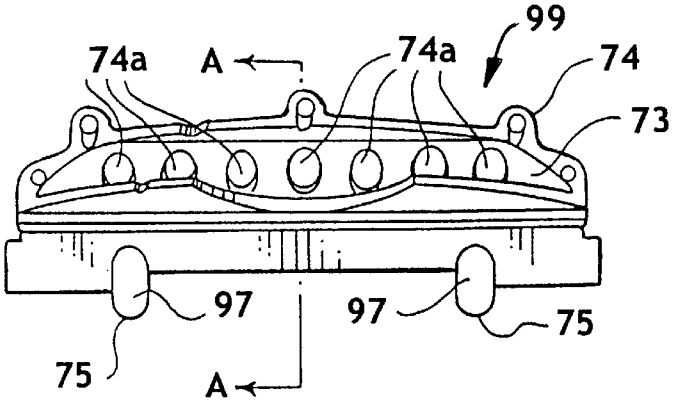

FIG. 19 is a back plan view of a wiper assembly.

Figure 20:
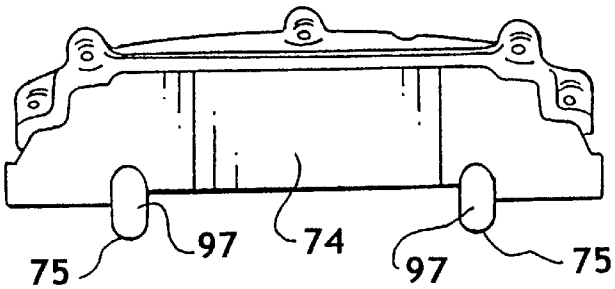

FIG. 20 is a front plan view of a wiper assembly.

Figure 21:
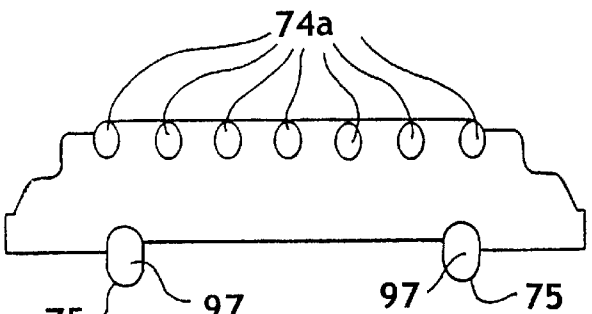

FIG. 21 is a back plan view of a wiper blade for use with the assembly of FIG. 20.

Figure 22:
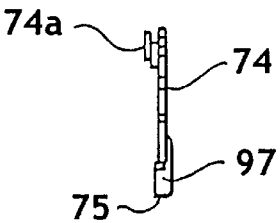

FIG. 22 is a cross-sectional view of the wiper blade of FIG. 21.

Figure 23:
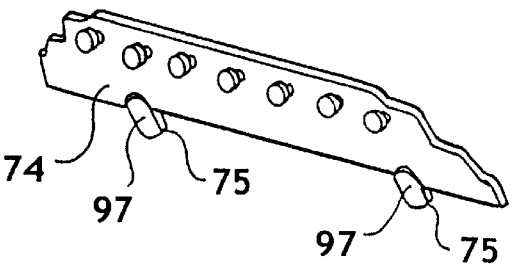

FIG. 23 is a back perspective view of the wiper blade of FIG. 21.

Figure 24:
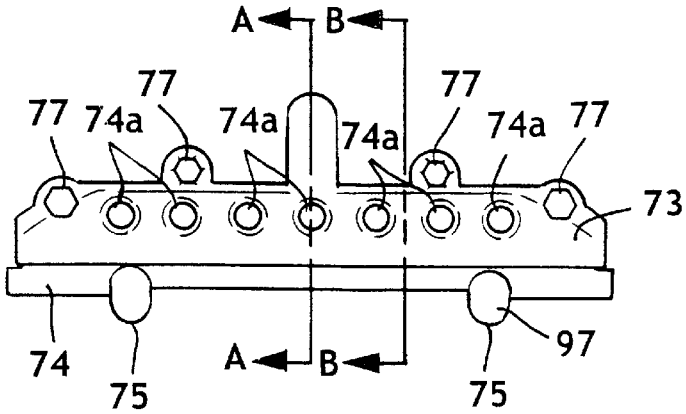

FIG. 24 is a back plan view of a wiper assembly.

Figure 25:
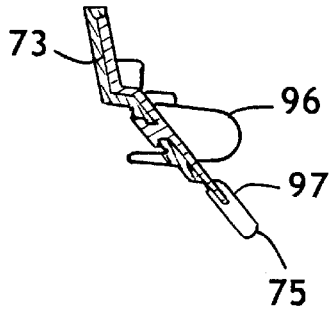

FIG. 25 is a cross-sectional view of the wiper assembly along line A—A of FIG. 24.

Figure 26:
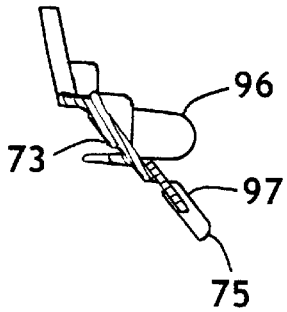

FIG. 26 is a cross-sectional view of the wiper assembly along line B—B of FIG. 24.

Figure 27:
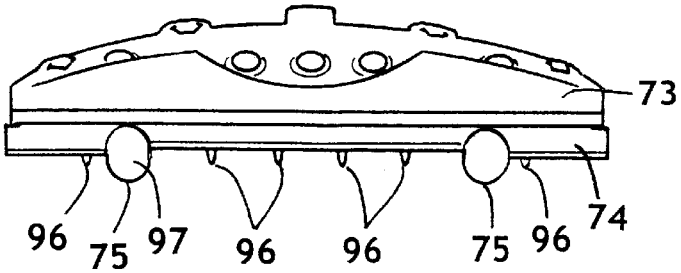

FIG. 27 is a back-bottom perspective view of the wiper assembly of FIG. 24.

Figure 28:
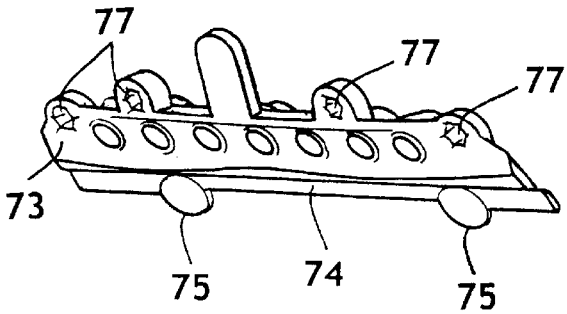

FIG. 28 is a back-top perspective of the wiper assembly of FIG. 24.

Figure 29:
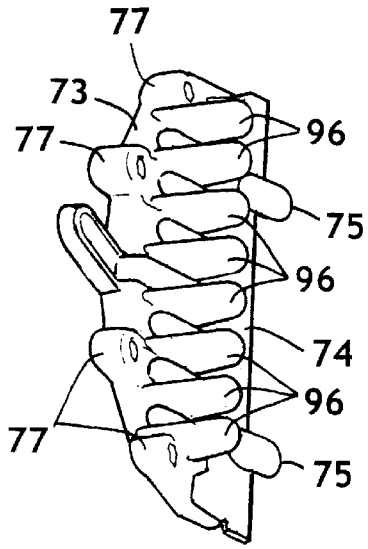

FIG. 29 is a front-top perspective of the wiper assembly of FIG. 24.

Figure 30:
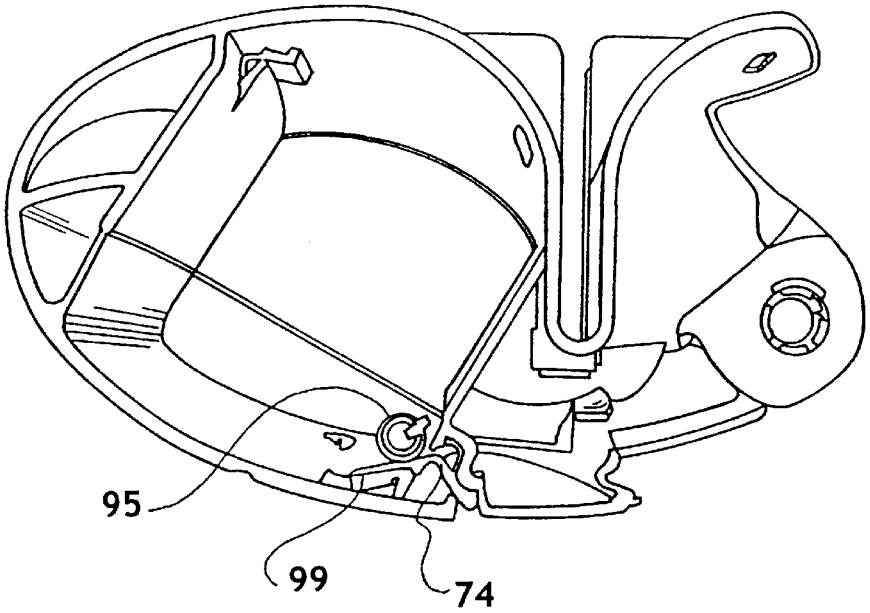

FIG. 30 is a cross-sectional view of a dispenser without a cartridge therein.

Figure 31:
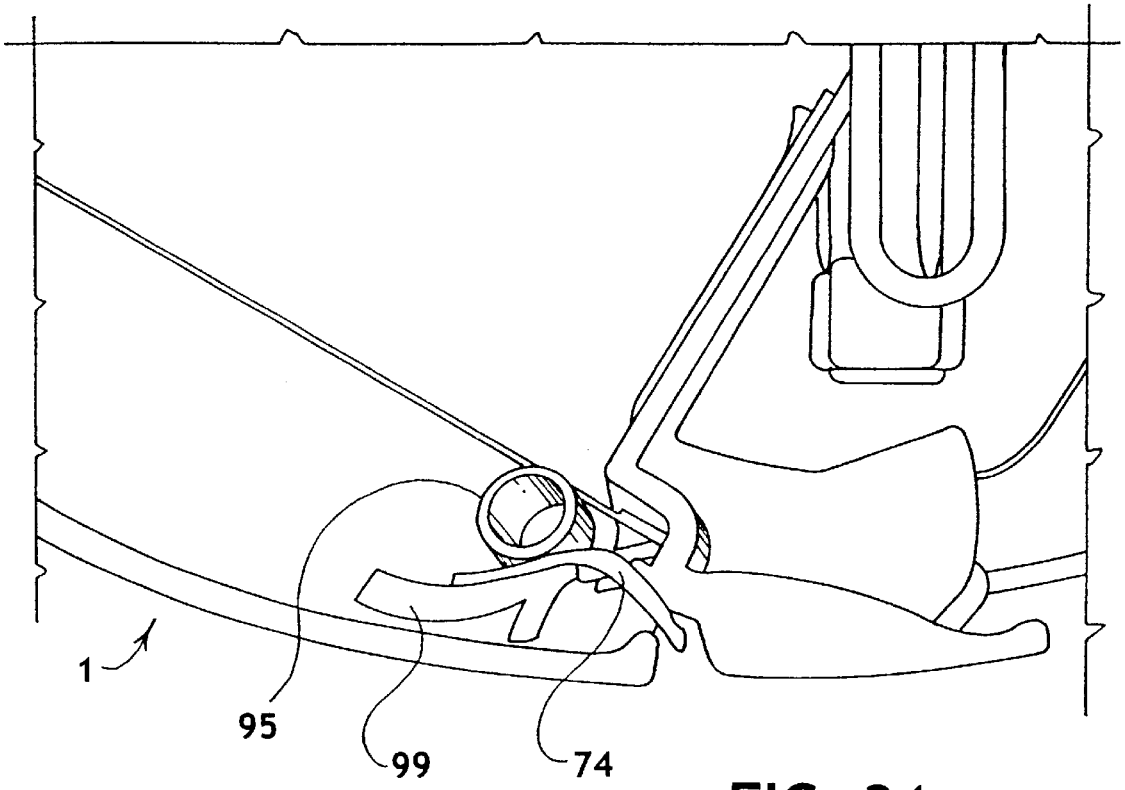

FIG. 31 is an exploded cross-sectional view of a portion of the dispenser of FIG. 30.

Figure 32:
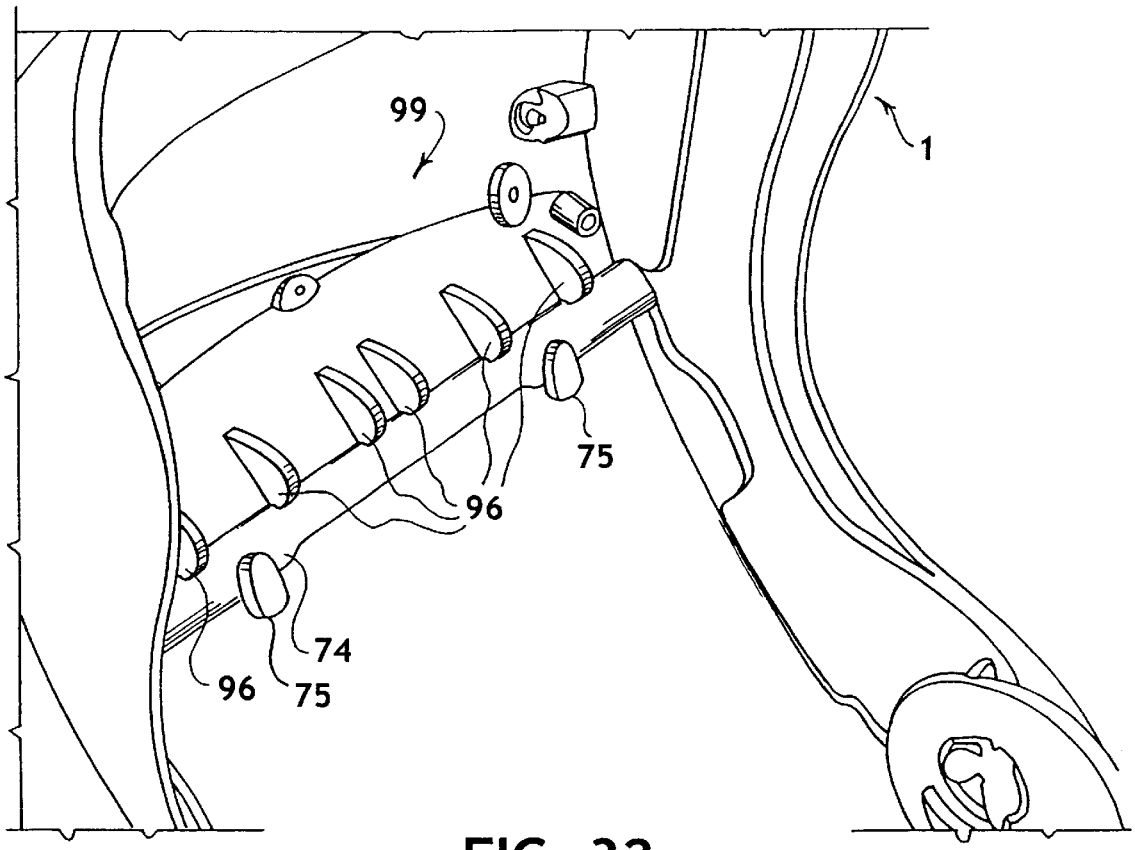

FIG. 32 is a perspective view of a portion of the inside of a cover for use with a dispenser.

Figure 33:
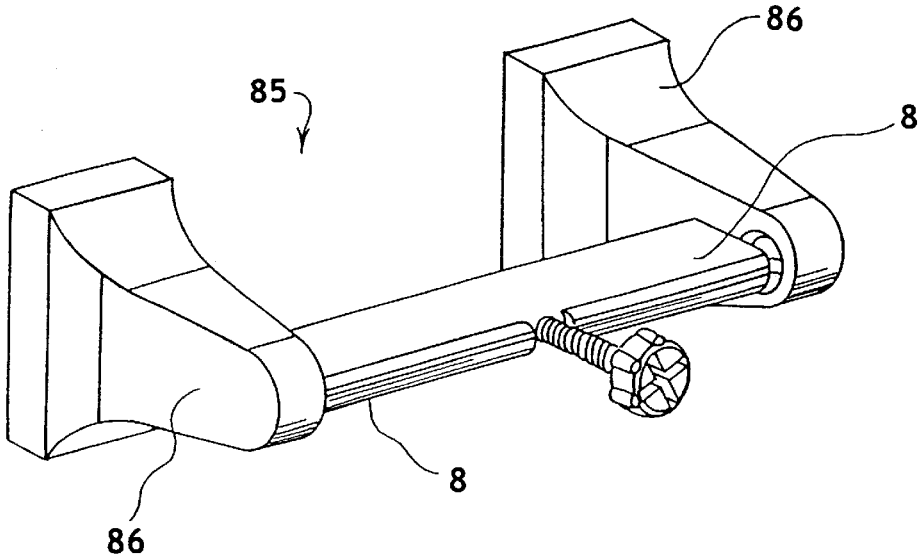

FIG. 33 is a perspective view of a mounting assembly in a conventional bath tissue holder (shown without a dispenser).

Figure 34:
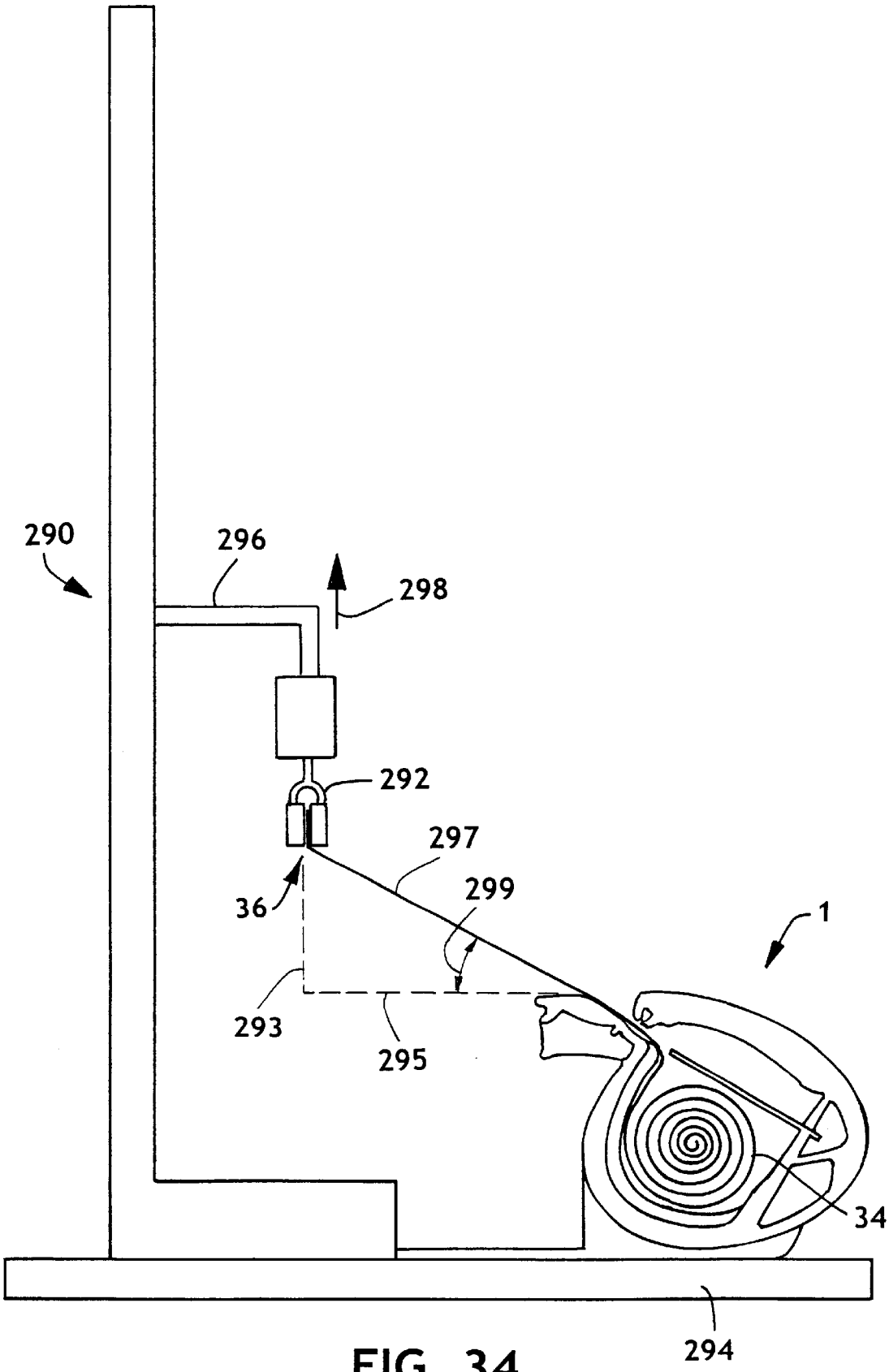

FIG. 34 is a schematic cross-sectional view of a dispenser and a test machine with wipes about to be dispensed in a test procedure.

Figure 35:
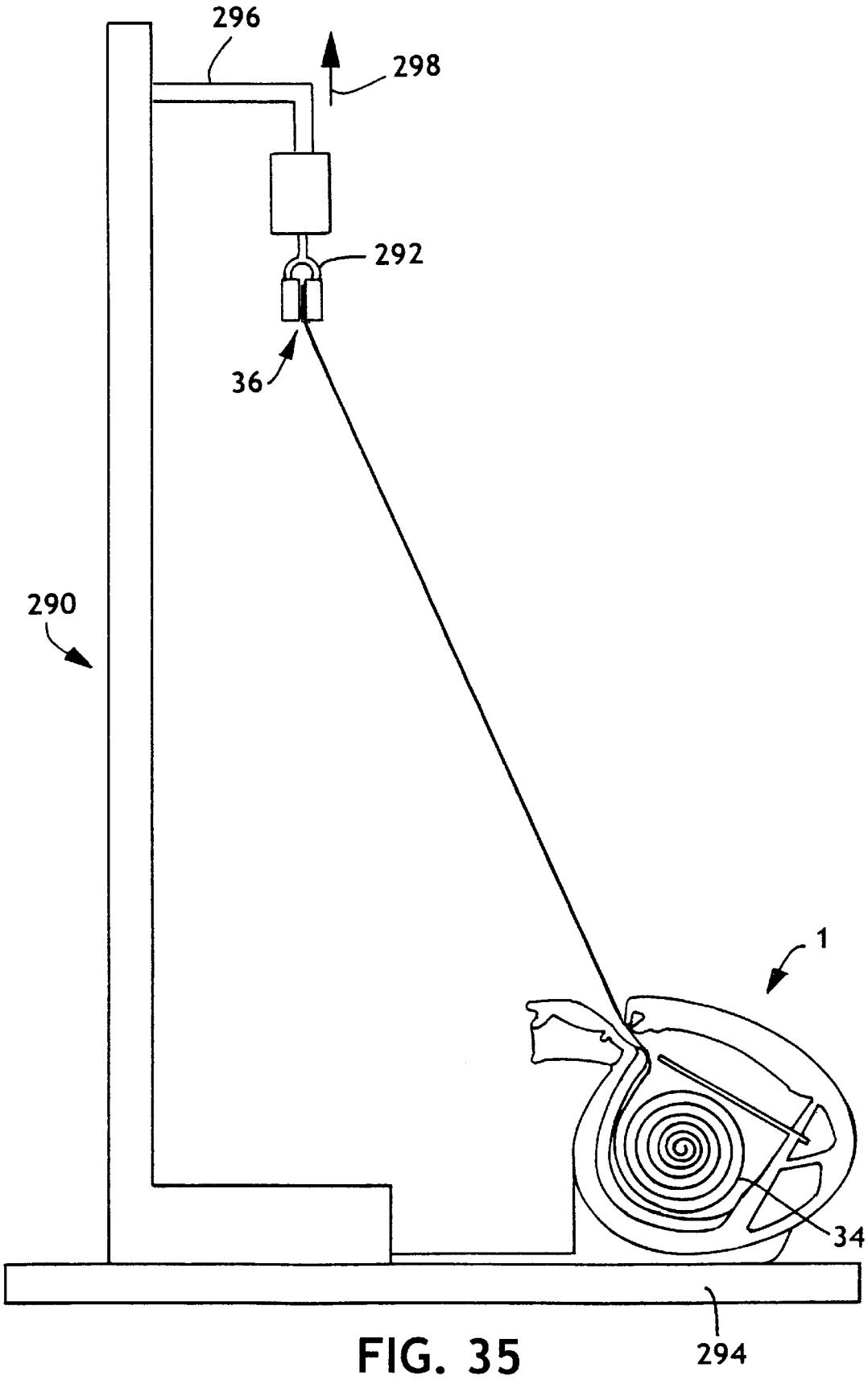

FIG. 35 is a schematic cross-sectional view of the dispenser, test machine and wipes of FIG. 34, but now with more wipes dispensed in the test machine's final position when a portion of the test procedure is complete.

DETAILED DESCRIPTION OF PRESENTLY PREFERRED EMBODIMENTS OF THE INVENTION

A system and method for dispensing and providing wipes is provided, which in general may have a housing, a cover, and a cartridge having a plurality of wet wipes. The plurality of wet wipes is placed in the housing and then the wipes can be removed from the dispenser.

In general there is provided a device for mounting a wet wipes dispenser to another surface. That surface may be, by way of example, a wall in a bathroom, a kitchen wall, or a bathroom vanity wall. The device may be used with, or adapted for use with, most any type of wet wipes dispenser, such as the various dispensers illustrated and disclosed herein. The device is ideally adapted to work in conjunction with a conventional bath tissue holder to permit a dispenser to be securely, yet removably attached to the wall. A conventional bath tissue holder is the type that is typically found in a home. Such holders have posts that protrude from the wall and a rod or roller that is positioned between the posts. These holders may also be partially recessed into the wall. Such a holder and a holder with a mounting assembly engaged are illustrated in FIG. 27. The device may also be used in the absence of a conventional bath tissue holder and may be adapted to provide that the dispenser is fixed to the wall.

For example, the system may have a dispenser that has a housing, which is capable of being mounted to a surface, such as a wall, a cabinet, an existing bath tissue dispenser, a toilet, a toilet tank, a stall wall, or a dashboard of an automobile. The dispenser has an opening that holds a cartridge, which contains the wet wipes. These cartridges are sealed. The user may then open a cartridge, put it in the dispenser, and use the wipes as needed. When the wipes are used up, the user may simply discard the old cartridge and replace it with a new one, or reuse the old cartridge and simply provide a new roll of wet wipes.

The present invention is directed at enhancing wet wipes and containers for wipes, e.g., rolls or stacks of wet wipes and dispensing of the same. As representatively illustrated throughout the figures, and for explanation now referring to FIGS. 1 through 5, inclusive, there is provided a dispenser 1, which has a housing 2, a tray 3, a cover 7, and a mounting assembly 8. The tray and the cover form a gap 4, through which a wet wipe can extend. That portion of the wipe extending through the gap may be referred to as a tail. The tray and cover additionally have recesses 5, that form an indentation that provides a finger hold, or point where a user can grasp the wet wipe to pull it from the dispenser. Although optional, this dispenser is also provided with a roller 6 for mounting and dispensing a roll of another product, such as dry or conventional bath tissue.

In general the dispenser system illustrated herein can be used with or without conventional dry toilet or bath tissue. If conventional tissue is used with wet wipes it could be positioned in a side-by-side manner, above, or below the wet wipes.

FIGS. 1 and 4–4B, inclusive, show the dispenser with the cover closed. In FIGS. 4 and 4B, it can be seen most easily that the dispenser generally has a top 100, a side 101, a side 102, a back 103, a bottom 104 and a front 105. FIG. 2 shows the dispenser and a cartridge in an exploded view. FIG. 3 shows the dispenser assembled and in a fully opened condition.

The housing may be made from any suitable material, such as plastic, wood, ceramic, porcelain, glass, paper, metal, thermoplastic elastomers, or composite materials. For example, polypropylene, polyesters such as polybutylene terephthalate (Pbt), Pbt glass filled, Pbt 15% glass filled, fiberglass, carbon fiber, and acrylonitrile-butadiene-styrene (ABS) may be used to make the housing.

The housing may have different shapes and sizes. When the dispenser is intended for use in a home it is desirable that it be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. Preferably the width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home. Smaller sizes may be desirable for certain applications or aesthetic reasons, such as a small bathroom. The dispenser and its components may have varied colors, such as the almonds and whites that are seen in porcelain bath fixtures or may have any other desirable color. When the housing is used for industrial or institutional purposes or in commercial applications it may be desirable to make the housing substantially larger and able to hold substantially more rolls of either or both wet and dry wipes and tissue.

The housing may be configured as shown in FIG. 1 to mount onto or into a conventional wall mount toilet paper holder. It may also be mounted directly to a wall, for example by way of a screw, through mounting hole 30, or by other means of fixing the housing to a wall or surface, such as glue, nails, screws, rivets, magnetic attachments, staples, engaging brackets and pressure mountings against the sides of a conventional wall mount for toilet tissues. The housing also may have a lock 13 that engages a tab 12 on the cover to keep the cover closed, yet provide an easy way to open the dispenser. Various other ways to lock or fix the cover to the housing may also be employed. For example, a lock and key approach may be desirable in commercial applications or houses where there are small children present.

The housing may also have an opening 14 that is made to receive cover mounts 29. The opening 14 and the cover mounts 29 may further be configured to receive a conventional toilet tissue roller. The housing may further be configured to support a means of dispensing, storing, containing or mounting another product such as wipes, toilet tissue, or the like. For example, the housing may support a shelf which may in turn support a container of wet wipes having the same or a different composition from that of the wipes inside the housing. The housing may further have an opening 28 for receiving a pin 27 on the tray 3.

The cover 7 may be made of any similar material to the housing; it may be the same as or a different material from the housing. The cover may be clear or have a window for viewing the amount of wet wipes that remain in the dispenser. It is noted, however, that because the cover is in direct contact with the wet wipe, the cover forms the top of the cartridge when the cartridge is inserted into the dispenser and the cover closed, and wood or any other material that would support bacterial growth would not be favored. It is preferred that all materials that are in contact with the wet wipes be made from materials that discourage, or do not support bacterial growth.

Moreover, anti-bacterial agents, medicinal, botanical or skin and health agents may be added to the materials that are used to construct the components of the dispenser system, including by way of example the dispenser housing, the tray, the wiper blade, the wiper assembly, the cartridge, the cover and the gaskets. In particular any component that is in contact or associated with the wet wipes may have such an agent added to it.

The cover is designed to cooperate with the cartridge 11 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and preferably for more than 14 days at room conditions of 73° F. (22.8° C.) and 50% relative humidity. The dispenser when fully closed can maintain at least about 15%, at least about 20%, at least about 25%, at least about 50%, at least about 65%, and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover may further be designed to cooperate with the cartridge 11, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the front cover and the surface of the lip of the cartridge may vary between about 2 mm and about 10 mm. In this way there is formed a dome above an open cartridge that at least partially covers that opening, which dome is preferably less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The cover may be provided with an inside rim 33 (see, e.g., FIG. 3) and a wiper or wiper assembly 10 (see, e.g., FIGS. 2 and 3). The cover inside rim and wiper cooperate with the lip 31 of the cartridge. In this way when the cover is closed the inside rim is brought against the lip of the cartridge and the wiper is similarly brought against the tray including the guides, as well as the lip of the cartridge. In a further embodiment, the cover may be provided with a lip, and the cartridge may be provided with a rim to facilitate the cooperation.

The distance between the inside of the cover where the wiper 10 is located and the tray may be less than the height of the wiper blade. Thus, in this configuration the wiper blade would be placed under compression against the lip, the tray, or the guides 16 or all of them depending on the position of the wiper. Here the wiper blade would exert pressure on at least a portion of the wet wipes. The wiper blade may also be positioned so that it contacts the wet wipe but does not exert pressure against it, or be positioned so that it is a short distance above the wet wipe. The amount of pressure that the wiper blade exerts on the wet wipe may vary depending upon several factors, including the purpose for the wiper, the material that the wiper blade is made from, the material that the wet wipe is made from and the material that the cartridge lip 31 is made from. Additionally, the wiper or wiper assembly and the wiper blade can be distinct parts, can be integrally joined together from distinct parts or can be integrally formed as one part with one or more of the wiper features.

The tray 3 may be made from any similar material to the housing or cover, and it may be the same material or different material from those of components. The tray may have side walls 22, 23, 80 and 81. Walls 22 and 23 correspond to the sides of the dispenser, wall 80 corresponds to the top of the dispenser, and wall 81 corresponds to the bottom of the dispenser. The tray shown in the figures does not have a back wall, although one may be provided if desired. The side walls may be provided with recesses 24, 25, and 26. These recesses cooperate with protrusions 19, 20 and 21 on the cartridge (19 with 26, 20 with 24 and 21 with 25). In this way the cartridge is securely, yet easily removably held in the dispenser. The tray opening 15 is sized in relation to the cartridge (or the cartridge may be sized in relation to the tray opening) so that the cartridge can easily be slid into and out of the dispenser.

Referring to FIGS. 2 and 2A, e.g., the housing may further have guides 16. The guides may be movable or fixed. The guides may have raised surfaces 16*a* and lowered surfaces 16*b*. These guides may be made from the same type of material as the housing. They may be integral with the housing. The guides and the housing may be one continuous piece of plastic. The guides may be designed to cooperate with the wiper to prevent or reduce the tendency of the wipe to skate to one side of the dispenser as the wipe is pulled out and torn off. The guides may also cooperate with the wiper to regulate and control the amount of drag between the wet wipe and the dispenser.

The cartridge may be made out of any suitable material, such as plastic. It is preferable that the cartridge be made from a light weight, inexpensive, disposable and recyclable material. The cartridge has side walls 17, 18, 39 and 40 and bottom wall 41. The cartridge has a lip 31 that forms an opening at the top of the cartridge. The cartridge may be any shape or size provided that it fits in or cooperates with the dispenser. For example a cartridge that would be useful for application in the home would have side walls 17 and 18 that are less than 105 mm and side wall 39 and 40 that are less than 134 mm. Instead of protrusions 19, 20 and 21, the cartridge may have recesses at those locations, and the tray may have corresponding protrusions.

The container for the wet wipes may also be flexible. A flexible package made of plastic, metal foil, paperboard or combinations thereof may be used to seal the wipes in a wrapper or may be configured as a pouch with a removable cover. Any material and configuration that prevents the loss of moisture from the wet wipes may be used to package the wipes. A removable cover may contain a removable strip to facilitate dispensing of the wipes. The cover may also contain a lip to cooperate with the cover inside rim and the wiper. The combination of the wipes and the container may be the same size as or smaller than the cartridge so as to fit within the tray.

FIG. 6 shows a dispenser in the closed condition with a tail of a wet wipe 36 protruding from gap 4 into the finger hold indentation that is formed by recess 5. In use the tail of the wet wipe would be grasped and pulled generally in the direction of arrow 35 causing the roll to unwind and the wipe to be dispensed from the dispenser. In use the wet wipe may also be subjected to forces tangential and perpendicular to the direction of arrow 35. If these forces occur the guides and the wiper help to prevent the wipe from skating to one side of the gap and bunching up or binding.

FIG. 7 is an exploded view of a dispenser, cartridge and roll of wipes 34 showing the relationship of these components.

FIG. 8 shows a roll of wipes 34 that has a tail 36 of the wipes extending through the gap 4, and further defines the axis of the roll as 37. Stacks or rolls useful with this dispenser or as part of a dispensing system may contain from as little as a few linear inches (or cm) to more than 450 linear inches (11.43 m), to more than linear 600 inches (15.24 m) to more than a thousand linear inches (25.40 m) of wet wipes. The stacks or rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5½ inches (139.7 mm), and preferably has a diameter of about 3 inches (76.2 mm) and more preferably of about 2⅞ inches (73.0 mm). This roll has from about 400 linear inches (10.16 m) of wipes to about 1000 linear inches (25.40 m) of wipes. Without limitation, each sheet length may be from about 3 inches (76.2 mm) to about 10 inches (254.0 mm) and preferably are about 4.5 inches (114.3 mm). This roll may further have a density of from about 0.3 g/cc to about 1 g/cc, from about 0.5 g/cc to about 1 g/cc and preferably about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

The preferred form of wet wipes for use with the dispenser system is a solid coreless roll as shown in FIG. 8. It is to be understood, however, that cored rolls (hollow cores, solid cores and partially solid cores), hollow coreless rolls, and stacks of sheets may also be used in the dispenser system. When density values are referred to herein, it is for the density of the roll and this would exclude any void, for a coreless hollow roll, or space occupied by a core for a cored roll.

Various tests and observations of physical properties are reported in Tables I, II, II, IV, V and VI.

Solution add-on level is the amount of solution by weight divided by the amount of dry wipe by weight multiplied by 100 to provide a percentage value.

Base sheet converting refers to the width of the roll and the sheets in the roll, i.e., along axis 37 of the roll in inches.

Perforation refers to the amount of cutting and the distance between the cuts in the perforation that separates the sheets in a roll. There are three parameters to this measurement: cut length, bond length and bond spacing. The bond spacing is equal to the sum of the cut length plus the bond length. By way of example, perforations that are useful with wet wipes are ones that have a bond length of 0.02 inch (0.51 mm), a cut length of 0.05 inch (1.27 mm), and a bond spacing of 0.07 inch (1.78 mm), or one that has a bond length of 0.04 inch (1.02 mm), a cut length of 0.09 inch (2.29 mm) and a bond spacing of 0.13 inch (3.30 mm).

Dry basis weight is the basis weight of the wipe before the solution is added to the wipe, i.e., before it is wet.

Wet thickness is the thickness of a wet wipe, i.e., after the solution has been added to it, in mm.

Sheet count is the number of sheets in a roll, i.e., the number of sheets created by the perforations.

Although all tests are done under TAPPI standard test conditions, the wet wipes are not equilibrated to those conditions. Instead, the wipes are removed from a sealed container or cartridge and tested within a few, generally less than 5–10, minutes after opening. This is about a 5 minute variation in this time period when the wet wipe is exposed to the atmosphere, which does not materially or significantly alter the test results.

Tensile, stretch and TEA (total energy absorbed) values were obtained on the wet product following ASTM 1117-80, section 7, with the following modifications: sample dimensions were 1+/−0.04 inch (25.4+/−1.0 mm) wide and 4.25+/−0.04 inches (108.0+/−1.0 mm) long; initial gauge length was 3+/−0.04 inches (76.2+/−1.0 mm); test speed is 12 inches/minute (305.0 mm/min).

MD tensile is the peak load before failure per inch width of the sample, as determined in the machine direction. CD tensile is the peak load before failure per inch width of the sample, as determined in the cross direction. MD stretch is the percentage of elongation the wipe has in the machine direction at the peak load. CD stretch is the percentage of elongation of the wipe in the cross machine direction at the peak load. Total Energy Absorbed (TEA) is the area under the force-elongation curve (in units of lb. and ft., respectively) from the start to the failure point divided by the initial surface area of the sample between the upper and lower grips. For these samples, this surface area was 3 sq. inches (19.4 $cm^2$). Ten specimens were tested for each code, and the average was calculated and reported. The test can be carried out on a standard tensile tester such as a MTS Sintech 1/G test machine with TestWorks 3.10 software. Both the Sintech test machine and the TestWorks software are available from MTS Corporation located at 1400 Technology Drive, Eden Prairie, Minn.

Detach refers to the force in grams (g) per sheet that is required to break a perforation, i.e., the amount of force required to separate two sheets in a roll along the perforation. These properties were determined using a MTS Sintech 1/G test machine with TestWorks 3.10 software. Two sheets were removed from a roll. The sheets had a width of 4.25 inches (108.0 mm), and were connected by perforations along the width. The sheets were folded in half along the length such that the width of the sample was 2⅛ inches (54.0 mm). The top and bottom of the sample along substantially the entire width were placed in grips having an internal spacing of 2 inches (50.8 mm), such that the perforation line was centered between the upper and lower grips. The upper grip was then displaced upward (i.e. away from the lower grip) at a rate of 10 inches/minute (254.0 mm/min) until the sample was broken along the perforations. The applied force and sample elongation were measured throughout the test. The peak load from the force-elongation curve is recorded so that the detach strength is expressed as force in units of grams/sheet. The average results from ten samples are reported in Tables I and II, and the average results from three or four samples are reported in Tables IV, V and VI.

Percentage strain at peak load ("% strain @ pk load") was determined from the results of the test described above. The elongation at the peak load is divided by the initial sample length of 2 inches (50.8 mm), and the result is designated the % strain @ peak load. The average results from ten samples are reported.

Wet thickness refers to the thickness of a wipe that is measured while the sample is subjected to a specified load or weight. The wet thickness of wet wipes and wipes before wetting are reported in Table II. These values are based on samples measuring 3×4 inches (76×102 mm) that were individually placed under a confining load of 0.05 pounds/square inch (psi) (345 Pa). The region of the sample that was tested was free of wrinkles and folds. A Starrett Comparator Base Model 653G was used to perform these tests available from Starrett, 121 Crescent St., Athol, Mass. 01331. This base is precision ground to be flat (tolerance of +/−0.001 inch, +/−0.025 mm). A digital displacement indicator (Sony model U30-1SET) was attached to the base via a cantilevered horizontal control arm supported by a vertical shaft. The indicator measures vertical displacement relative to the comparator base to within 0.001 inch (0.025 mm). The load was applied by an acrylic contact foot attached to a vertically traveling spindle shaft that descended to the comparator base. The foot has a diameter of 3.00 inches (76.2 mm), a height of 0.63 inch (16.0 mm) and is flat on the lower surface to a tolerance of +/−0.001 inch (0.025 mm). The weight of the contact foot, spindle, and the associated hardware, not including the contact force springs in the indicator, is 160.5+/−0.1 g. The spindle shaft descends to the comparator base with a travel time of 0.5 seconds to 0.75 seconds. The thickness was measured by the indicator as the height of the wipe relative to the surface of the comparator base immediately after the load pressure of 0.05 psi (345 Pa) was applied for 3 seconds. Calibration before testing was performed on a set of standard samples traceable to the National Bureau of Standards. By way of example and without limitation, wet wipes useful in the present dispensing system may have a dry basis weight from about 10 to about 200 gsm, a dry thickness from about 0.5 to about 2 mm, a wet (i.e., wipe with solution or wetting material added) thickness from about 0.3 to about 0.7 mm, a MD wet tensile at least about 250 g/inch (9.8 g/mm), a CD wet tensile at least about 200 g/inch (7.9 g/mm), a MD wet stretch from about 5% to about 30%, a CD wet stretch from about 5% to about 36%, a TEA MD wet strength of from about 0.5 to 2 ft-lb/sq. inch (0.10 to 0.4 $J/cm^2$), a TEA CD wet strength of from about 0.5 to 2 ft-lb/sq. inch (0.10 to 0.4 $J/cm^2$), and a solution add-on of about 100–600%, preferably of about 150%–350%. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe".

Peel force measures the amount of force in grams/4.25 inches (g/108.0 mm) required to unroll a roll of wet wipes, i.e., the grams required to unroll a roll that is 4.25 inches (108.0 mm) wide. Thus, these values could be normalized to apply to any width roll in grams/inch of roll width basis. The peel force, as reported in Table II was the force required to unroll a roll as it was resting in an open cartridge and was measured with an MTS Sintech 1/G test machine with TestWorks 3.10 software. A 4.5-inch (114.3 mm) wide clamp with rubber surfaces gripped the tail of a roll, with the roll positioned directly underneath the clamp such that the tail would remain vertical as it was unwound from the roll. The clamp was attached to the crosshead, which pulled the tissue web upward at a speed of 100 cm/minute. Peel force was measured by a 50 Newton load cell. The average load to pull 18 to 20 sheets away from the roll was recorded by averaging two runs in which 4 sheets each were separated and two runs in which 5 sheets each were separated. Only the first 18 to 20 sheets from the roll were used to obtain the measurements of Table II.

The dispensing force, which is the force measured in grams force (g) to pull the wet wipes from the dispenser, can also be determined. This force can be measured with a MTS Sintech 1/G test machine equipped with TestWorks 3.10 software. Referring to FIGS. 34 and 35, such a Sintech test machine 290 and dispenser 1 with wipes 34 are representatively shown in cross-sectional view. In FIG. 34 the dispenser is secured in place to platform 294 in a horizontal orientation underneath a clamp 292. The relative orientation of the dispenser to that of the clamp 292 is similar to the way wipes are dispensed from the dispenser during its intended use. The clamp 292 has rubber surfaces which grip substantially the entire width of the tail 36 of the roll of wet wipes 34 placed in the dispenser. For the samples in Tables IV, V and VI, the initial distance 293 between the clamp and the gap of the dispenser is about 8 inches (304.8 mm) and the distance 295 from the middle of clamp 292 to the dispensing gap is about 6 inches (150 mm), such that the distance 297 along the diagonal trajectory of dispensing wipes between the clamp and the gap is about 10 inches (250 mm). The clamp is attached to the crosshead 296, which pulls the roll upward in direction 298 at a speed of 100 cm/min to a final position as seen in FIG. 35. The angle 299 during dispensing of the wipes from the start of a run until the end should be in the range of angles between about 50° and 80°, but may have to be readily varied to mimic these conditions for the sample dispenser depending on structural features of the actual dispenser used for testing. As concerns the angle 299 compared to the dimensions 293, 295 and 297, it is the angle that controls and not the particular dimensions but rather any proportional dimensions that would still achieve the desired range of angles from 50° to 80° for dispensing wipes pursuant to this dispensing force test. When dispensing the wipes for testing, the dispenser should be lined up with the test clamp so that as the test clamp ascends it pulls wipes out of the dispenser between parallel planes defined by the sides of the dispenser. That is, the wipes will be dispensed out of the dispenser rather evenly between the sides so as to not be biased more toward one side than the other. The pull force is measured by a 50 Newton load cell. For each run, the pull force as a function of pull distance curve for pulling 4 to 5 sheets away from a roll is recorded using the TestWorks 3.10 software. Based on the curve, the peak pull force for each run is calculated. The average peak pull force of three runs is used to represent the dispensing force of a given roll. Only the first 12 to 15 sheets from the roll were used to obtain the measurement, i.e. 4 to 5 new sheets for each run.

Table I sets out types of wet sheets and their properties. In Example 1, the solution was a sufficient amount of commercial (no salt) solution such as that which is used in the commercially available KLEENEX® COTTONELLE® flushable moist wipes product of Kimberly-Clark Corporation. In Example 2, the solution was a sufficient amount of 4% salt water solution such as a simple 4% salt water solution with other additives as disclosed in the examples of wet wipe applications discussed previously in the Background of Invention, all of which have been and are incorporated herein by reference.

TABLE I

| | Non-Dispersible Wet Wipe Example 1 | | Dispersible Wet Wipe Example 2 | |
|---|---|---|---|---|
| Basis Weight | 60 gsm | | 60 gsm | |
| Solution | commercial (no salt) | | 4% salt solution | |
| Solution Add on level | 175% | | 228% | |
| Basesheet Converting | 4.25" width | | 4.25" width | |
| Perforation Bond Spacing | 0.11" | | 0.07" | |
| | Run Average | Run STDev | Run Average | Run STDev |
| Dry Basis Weight (gsm) | 57 | 2 | 66 | 4 |
| Wet Thickness (mm) | 0.56 | 0.02 | 0.47 | 0.01 |
| Sheet Count | 99 | 0.7 | 99 | 1.1 |
| Wet tensiles | | | | |
| MD Tensile (g/in) | 380 | 26 | 321 | 30 |
| MD Stretch (% Elongation) | 23 | 1.4 | 28 | 1.6 |
| TEA (Ft-Lb/Sq. In) | 0.96 | 0.06 | 1.02 | 0.07 |
| CD Tensile (g/in) | 329 | 28 | 287 | 29 |
| CD Stretch (% Elongation) | 28 | 1.8 | 34 | 3.5 |
| TEA (Ft-Lb/Sq. In) | 0.93 | 0.09 | 0.97 | 0.13 |
| Detach (g/sheet) | 752 | 21 | 853 | 34 |
| % strain @ pk load | 8 | 0.5 | 11 | 1.1 |

Table II contains additional data reflecting the properties of disposable wet wipes. This table shows the effects that changing base sheet and solution variables has on the physical properties of the wipes. The pulp used to make these sheets was Weyerhauser CF 405. For this example, the binder was example Code E, Table 15, of Ser. No. 09/564,531. This binder material had a molecular weight of 610,000 and was made from the following monomers provided in the following weight percents: 60% acrylic acid, 24.5% butacrylic acid, 10.5% 2-ethylhexyl-acrylic acid, and 5% AMPS (2-acrylamido-2-methyl-1-propanesulfonic acid).

TABLE II

| | Basesheet Variables | | | |
|---|---|---|---|---|
| | 100% pulp/ 65 gsm 22% binder/ 1.1 mm dry thickness | 100% pulp/ 60 gsm 20% binder/ .76 mm dry thickness | 100% pulp/ 55 gsm 20% binder/ .76 mm dry thickness | 15% PET/ 55 gsm 20% binder/ .84 mm dry thickness |
| | Solutions 0.5% silicone; 0.25% lanolin | | | |
| | Example 3 | Example 4 | Example 5 | Example 6 |
| MD Wet Tensile (g/l") | 500 | 452 | 383 | 391 |
| CD Wet Tensile (g/l") | 445 | 403 | 344 | 310 |
| wet thickness (mm) | 0.46 | 0.40 | 0.39 | 0.41 |
| peel force | 167 | 131 | 106 | |
| | Solutions 1.0% silicone; 0.25% lanolin | | | |
| | Example 7 | | Example 8 | Example 9 |
| MD Wet Tensile (g/l") | 473 | | 401 | 416 |
| CD Wet Tensile (g/l") | 455 | | 348 | 350 |

TABLE II-continued

| | Basesheet Variables | | | |
|---|---|---|---|---|
| | 100% pulp/ 65 gsm 22% binder/ 1.1 mm dry thickness | 100% pulp/ 60 gsm 20% binder/ .76 mm dry thickness | 100% pulp/ 55 gsm 20% binder/ .76 mm dry thickness | 15% PET/ 55 gsm 20% binder/ .84 mm dry thickness |
| wet thickness (mm) | 0.45 | | 0.40 | 0.39 |
| peel force | 170 | | 120 | 115 |

| | Solutions 1.0% silicone; 0.0% lanolin |
|---|---|
| | Example 10 |
| MD Wet Tensile (g/l") | 528 |
| CD Wet Tensile (g/l") | 462 |
| wet thickness (mm) | 0.44 |
| Peel force | 162 |

Table III sets out the physical properties of rolls of wet wipes made according to the teachings for making wet wipes set forth herein. Tables IV, V and VI set out perforation detach strength data and dispensing force data for sample wet wipes made according to the teachings for making wet wipes set forth herein and for samples of wet wipes which are commercially available products of others, all of which fall within the scope of the present invention.

TABLE III

Coreless Roll Measurements and Calculations

| Roll Number | Measured Diameter (inches) | Unwound Wet Thickness (mm) | Calculated Roll Density (g/cm$^3$) | Calculated Effective Thickness (mm) | Compression Factor (%) |
|---|---|---|---|---|---|
| 1 | 2.77 | NA | 0.621 | 0.340 | 71% |
| 2 | 2.83 | 0.41 | 0.595 | 0.355 | 74% |
| 3 | 2.86 | NA | 0.583 | 0.362 | 76% |
| 4 | 2.90 | NA | 0.567 | 0.373 | 78% |
| 5 | 2.96 | 0.478 | 0.544 | 0.388 | 81% |
| 6 | 2.86 | NA | 0.583 | 0.362 | 76% |
| 7 | 2.98 | NA | 0.537 | 0.393 | 82% |
| 8 | 2.88 | NA | 0.575 | 0.368 | 77% |
| 9 | 2.94 | NA | 0.552 | 0.383 | 80% |
| 10 | 2.86 | 0.448 | 0.583 | 0.362 | 76% |
| 11 | 2.86 | NA | 0.583 | 0.362 | 76% |
| 12 | 2.84 | NA | 0.591 | 0.357 | 74% |
| 13 | 3.00 | NA | 0.530 | 0.399 | 83% |
| 14 | 2.86 | NA | 0.583 | 0.362 | 76% |
| 15 | 2.86 | NA | 0.583 | 0.362 | 76% |

Initial sheet length = 5 inches
Initial sheet width = 4.125 inches
Number of sheets in roll = 90
Dry basesheets basis weight = 65 gsm
Target solution add-on = 225%
Calculated roll weight = 253 grams
Assumed wet thickness prior to winding = 0.48 mm
Compression factor = calculated effective thickness (wound)/assumed wet thickness prior to winding
Calculated Roll Density = weight/$\pi d^2/4$ × width (calculated roll weight/$\pi$ · measured diameter$^2$/4 · initial sheet width)
Calculated Effective Thickness-calculated thickness of sheet in roll under pressure of winding.

TABLE IV

| 35 Durometer Wiper Blade | Sample A | Sample B | Sample C | Sample D |
|---|---|---|---|---|
| Sheet Width in inches (in cm) | 4.125 (10.3 cm) | | 4.250 (10.6 cm) | 3.875 (9.7 cm) |
| Actual Detach Strength (g/sheet) | 919 | | 581 | 390 |
| Actual Dispensing Force (g/sheet) | 210 | (1) | 138 | 121 |
| Detach Strength Characteristic (g/cm) | 89 | | 55 | 40 |
| Dispensing Force Characteristic (g/cm) | 20 | | 13 | 12 |
| Ratio of Detach to Dispensing | 4.38 | | 4.21 | 3.22 |

(1) This product was not tested with the 35 durometer wiper blade.

TABLE V

| 50 Durometer Wiper Blade | Sample A | Sample B | Sample C | Sample D |
|---|---|---|---|---|
| Sheet Width in inches (in cm) | 4.125 (10.3 cm) | 4.125 (10.3 cm) | 4.250 (10.6 cm) | 3.875 (9.7 cm) |
| Actual Detach Strength (g/sheet) | 919 | 1334 | 581 | 390 |
| Actual Dispensing Force (g/sheet) | 255 | 391 | 307 | 278 |
| Detach Strength Characteristic (g/cm) | 89 | 129 | 55 | 40 |
| Dispensing Force Characteristic (g/cm) | 25 | 38 | 29 | 29 |
| Ratio of Detach to Dispensing | 3.60 | 3.41 | 1.89 | 1.40 |

TABLE VI

| 52 Durometer Wiper Blade | Sample A | Sample B | Sample C | Sample D |
|---|---|---|---|---|
| Sheet Width in inches (in cm) | 4.125 (10.3 cm) | 4.125 (10.3 cm) | 4.250 (10.6 cm) | 3.875 (9.7 cm) |
| Actual Detach Strength (g/sheet) | 919 | 1334 | 581 | 390 |
| Actual Dispensing Force (g/sheet) | (2) | 374 | (3) | (4) |
| Detach Strength Characteristic (g/cm) | | 129 | | |
| Dispensing Force Characteristic (g/cm) | | 36 | | |
| Ratio of Detach to Dispensing | | 3.57 | | |

(2) The product was not tested with a 52 durometer wiper blade..
(3) The product did not dispense well, if at all, tended to tear mid-sheet or between sheets so continuous dispensing of multiple sheets throughout test procedure was not possible.
(4) The product did not dispense well, if at all. Tended to tear mid-sheet or between sheets so continuous dispensing of multiple sheets throughout test procedure was not possible.

Referring to Tables IV, V, and VI, Samples A and B are rolls of wet wipes made according to the teachings for making wet wipes set forth herein, and as such, they are similar to the Examples of wet wipes set forth in Tables I, II and III herein for moistened dispersible wet wipes. In particular, without limitation, Sample A had approximately the following properties: 67.6 gsm dry basis weight, 4% salt solution at an add-on of 225% of the dry basis weight, 0.040 inch perforation bond length, 0.090 inch perforation cut length, 0.38 mm wet thickness, 446 g/inch MD Tensile, and 387 g/inch CD Tensile. In particular, without limitation, Sample B had approximately the following properties: 63.7 gsm dry basis weight, 4% salt solution at an add-on of 225% of the dry basis weight, 0.040 inch perforation bond length, 0.090 inch perforation cut length, 0.37 mm wet thickness, 476 g/inch MD Tensile, and 462 g/inch CD Tensile.

Samples C and D are commercially available products of others. Sample C is that known as Moist Mates™ Moist Toilet Tissue on a Roll, sold by Cotton Buds, Inc. of Placentia Calif. USA and obtained by applicants at about August 2000 from Dallas, Tex. Sample D is that known as Fresh & Clean® wet toilet paper, sold by Sodalco S.p.A. Corsico (Mi) (www.sodalco.it and www.sodalco.com) and obtained by applicants at about September 2000 from Italy.

All Samples A through D were tested in a prototype dispenser of applicants' for dispensing wet wipes, according to the protocol discussed herein for determining dispensing force. The dispenser was like that seen in FIGS. 1A to 5, inclusive, and the supporting specification, of the prior U.S. patent application of the present assignee titled, "WET WIPES", U.S. Ser. No. 09/659,307 filed Sep. 12, 2000. In particular, without limitation, sample wet wipes were placed in the dispenser and a tail of the sample roll extending out the gap for dispensing. As such, the wiper blade had a thickness along its width (i.e., on either side of fingers 75) of about 0.060 inches and a thickness at fingers 75 of about 0.150 inches. The wiper assembly and blade were configured like that seen and described in FIGS. 24–29 herewith. The wiper blade was found to engage the wet wipes located in the gap, as determined in a direction across the width of the wet wipes, at most locations of the blade. The wiper blade had an overall width greater than the width of the wet wipes and was made of a resilient material known as DynaFlex™ G2755 sold by GLS Corp. of McHenry, Ill., USA and included ½% erucamide wax such as that known by trade name Kemamide™ wax sold by Witco Corp. of Greenwich, Conn., USA, that blooms to the surface during use to lower the initial coefficient of friction between the dispensing wet wipes and the wiper blade. The wiper blade having a hardness of 35 (shore A) durometer had: 285 psi tensile strength, 58 pli tear strength, specific gravity of 0.95 g/cc, and 20% compression set (room temperature only). The wiper blade having a hardness of 50 (shore A) durometer had: 490 psi tensile strength, 120 pli tear strength, specific gravity of 1.18 g/cc, and 22%/40% compression set (room temperature/ 70° C.). The wiper blade having a hardness of 52 (shore A) durometer had: 615 psi tensile strength, 125 pli tear strength, specific gravity of 0.89 g/cc, and 23%/35% compression set (room temperature/70° C.).

The dispenser and wiper blade were the same for Tables IV, V, and VI, in all regards except for the hardness (as noted in the upper left of each table) and respective related characteristics of the wiper blade recited just-above. The wiper blade described for testing was positioned in the dispenser generally opposite a cartridge positioned like that seen in FIGS. 9, 10, 34 and 35. As such, the front surface of the wiper blade was approximately parallel to the opposite surface of the cartridge, e.g., the lower lip 31 closest to the apex of angle 43 in FIG. 10. Also, the front most surface of ridges 96 (FIGS. 9 and 10) would be positioned about adjacent the plane defined by a cover of the cartridge and form a space between the ridges and the inside of the cartridge within the lip 31 to allow the wet wipe to pass between the ridges 96 and the cartridge and then adjacent that between the ridges 96 and the wiper blade and the tray 3. As explained herein, the wiper assembly, including wiper blade, could be in various positions depending on various dispensing characteristics desired, and this just happened to be the one used when testing was conducted.

Testing to obtain the relevant values recorded in Tables IV, V, and VI was generally done according to the test procedures and protocol discussed above for Tables I through III. Samples A through D are the same wet wipe product for each of the Tables. In these Tables, the "Actual Detach Strength" is a measure of the force required to separate two sheets joined by a weakened line, e.g., perforations, there between, according to the procedure for determining detach discussed previously, and recorded as grams (g) force per sheet. This value was then normalized based on the width of the sheet, that is grams (g) force per sheet divided by the width of the sheet, to determine the "Detach Strength Characteristic," which is also referred to interchangeably herein as the "Perforation Detach Strength Characteristic." The "Actual Detach Strength" is a measure dependent only upon the wet wipe, i.e., the basesheet properties which can include wetting solution, and not upon any dispenser for the wet wipes. The "Actual Dispensing Force" is a measure of the force required to dispense sheets from a roll of wet wipes out of a dispenser, according to the procedure for determining dispensing force discussed previously, and recorded as grams (g) force per sheet. This value was then normalized based on the width of the sheet, that is grams (g) force per sheet divided by the width of the sheet, to determine the "Dispensing Force Characteristic." The final row in the Tables shows a ratio of the Perforation Detach Strength Characteristic to the Dispensing Force Characteristic, identified in the Tables as "Ratio of Detach to Dispensing."

The dispensing force, also called interchangeably herein "actual dispensing force," should be less than the detach force for a roll of perforated wipes. In this way it is better assured that the wipes will be able to be pulled from, or removed from, the dispenser without inadvertently breaking the perforation. Thus, a dispensing force of from about 100 g to about 800 g is contemplated, a dispensing force of from about 150 g to 400 g is further contemplated and ideally a dispensing force of less than 300 g is desirable, with forces normalized based on g/4.25 inches (g/10.8 cm). Normalized, these forces are 23.5 g/inch (9.3 g/cm) to 188.2 g/inch (74.1 g/cm), 35.3 g/inch (13.9 g/cm) to 94.1 g/inch (37.1 g/cm), and 70.6 g/inch (27.8 g/cm). Additionally, the following ranges for the dispensing force characteristic can be advantageous towards enhancing the dispensing of a roll of wet wipes from a dispenser, e.g., the dispensers disclosed herein as well as any others that could be similar in certain regards, in order of increasing preference: the dispensing force characteristic is greater than 0 g/cm and less than about 75 g/cm, less than about 65 g/cm, less than about 55 g/cm, less than about 45 g/cm, or less than about 35 g/cm.

Opposite of the dispensing force, the detach force, also called interchangeably herein "perforation detach strength" or "actual detach strength," should be greater than the dispensing force for a roll of wipes with weakened lines, e.g., perforations. In this way it is better assured that the wipes will be able to be pulled from, or removed from, the dispenser without inadvertently breaking the perforation while the following wipe is still completely inside the dispenser or before the user desires to disconnect two adjacent wipes externally to the dispenser. Further, by selecting a particular detach force or range of forces, forces that are more user friendly (i.e., one that a human child to an aging adult can pull apart from an adjacent wipe as desired) and/or manufacturing friendly (i.e., flexible in light of possible variability between raw materials) can be chosen to compliment the other dispensing characteristics, all of which individually and collectively can be mixed and matched to enhance a dispensing system as taught herein. Thus, and at least in part depending on the dispensing force, the following ranges for the perforation detach strength characteristic can be advantageous towards enhancing the dispensing of a roll of wet wipes from a dispenser, e.g., the dispensers disclosed herein as well as any others that could be similar in certain regards, in order of increasing preference: the perforation detach strength characteristic is greater than 55 g/cm, greater than about 60 g/cm, greater than about 65 g/cm, greater than about 75 g/cm, or greater than about 85 g/cm. Additionally, the perforation detach strength characteristic can be any of these and can also preferably be less than about 150 g/cm.

The applicants have also discovered that the dispensing of wet wipes from a dispenser can be evaluated from the perspective of a ratio of particular dispensing characteristics, rather than just one characteristic or another. This discovery stems, at least in part, from a finding and belief that while certain dispensing characteristics are dependent upon one another, they can also be, to at least some degree, independent of one another. As such, evaluating a ratio of certain characteristics can provide additional and/or different measurements of the cooperation between wet wipes and a dispenser from which they are dispensed, i.e., way to quantify the enhanced dispensing of wipes. One such ratio is that of the perforation detach strength characteristic to the dispensing force characteristic. In order of increasing preference, this ration can be: greater than 1:1, equal to or greater than about 1.5:1, equal to or greater than about 2:1, equal to or greater than about 2.5:1, equal to or greater than about 3:1, equal to or greater than about 4:1, equal to or greater than about 5:1, equal to or greater than about 6:1, or equal to or greater than about 7:1.

An example of the dependent/independent nature of certain dispensing characteristics is seen in comparing Table IV to that of Table V. More particularly, comparing the values for Sample A to those for Samples C and D in the respective Tables. One sees that the sheet width and detach force for the Samples is constant throughout the Tables for each Sample, respectively. Notably, although Samples C and D have a lower dispensing force than that of Sample A in Table IV with a 35 durometer wiper blade, Samples C and D have a higher dispensing force than Sample A in Table V with the 50 durometer wiper blade.

Generally a peel force of from 80 g–300 g (per 4.25 inches, 108.0 mm) is contemplated, although lower peel forces may be obtained with different types of wipe products. The cartridge adds minimal resistance to the roll as it is unwound. Thus, the force required to unwind a roll is not materially increased by the cartridge. The roll or stack of wipes may also be placed directly in the tray for dispensing, without the use of a cartridge.

FIG. 9 shows the roll 34 as it is placed in a cartridge in a dispenser. The spiral line 38 is intended to represent the manner in which the roll is wound and depicts in that configuration a roll that is being unwound from the bottom. The use of a cartridge is not necessary, although it or a similar structure for retaining moisture in the roll and/or providing a place for excess moisture to collect, is preferred. FIG. 9 further shows a relationship for the wiper 10 to the wet web.

FIG. 10 shows a portion of a cartridge 11, the lip 31 of the cartridge, and the side walls 39 and 40. The angle at which the cartridge is positioned has an effect on how well the dispenser will perform. The angle will have a tendency to increase or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 31 forms with a true vertical axis, shown as 42. For a dispenser system as shown in FIGS. 1–9, the angle 43 that the lip 31 has with a true vertical axis 42 should be from about 10 degrees to about 80 degrees, from about 20 degrees to about 70 degrees, at least greater than 20 degrees, at least smaller than 60 degrees, and preferably about 30 degrees.

Further the angle may be selected such that it balances the forces between the peel forces associated with unrolling the roll and the weight of the roll forcing it down. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 43 is increased the difference between the height of the top of the roll and the tail is decreased, thus decreasing any siphoning driving force.

FIG. 11 shows an example of a cover. In this example the cover 7 has cover mounts 29, a recess 5 for forming part of a finger hold indentation, an inside rim 33, which has a top inside rim section 45 and side inside rim sections 46 (of which only one can be seen in FIG. 10), leg sections 72, and posts 44. In this example the posts are used to connect the wiper 10 (not shown here) to the cover by mounting holes 77 (FIGS. 24–29, e.g.).

In a further example of the tray, the tray is fixed to the housing. This may be accomplished by having the housing and tray being made out of a single piece of material or having the housing and tray joined together by a permanent bonding means, such as welding, heat bonding or gluing. In yet a further example the tray may be attached to the housing so that is cannot rotate with respect to the housing, yet still may be removable.

FIGS. 12 through 16 show an example of a wiper assembly or wiper 10. In this example the wiper assembly 10 comprises a chassis 48, and a blade 50 that has fingers 49. In this example the fingers are designed to cooperate with the lowered surfaces **16*b* (FIG. 2**A) of the guides on the housing. In this example the blade is made of SANTOPRENE® and the chassis is made of polypropylene.

FIGS. 17 and 18 show an example of a wiper blade. In this example the wiper blade is formed of a single piece (see FIG. 17) of material that is folded over to form the wiper blade (see FIG. 18). The wiper blade has raised portions 51 that reduce the amount of surface area of the wiper blade that contacts the sheet and raised areas 53 and lowered areas 52 that cooperate with the raised and lowered areas of the guides.

FIGS. 19 through 23 show an example of a wiper or wiper assembly 10. In this example the wiper comprises a chassis 73, and a wiper blade 74 (**74*a* shows sections of blade engaging and protruding through the chassis) that has fingers 75. In this example the fingers are designed to cooperate with the lowered surfaces of the guides 16 in the dispenser. In this example the blade is made of SANTOPRENE® and the chassis is made of polypropylene. This example contains raised or thicker areas 97 of the wiper. These raised areas cooperate with the guides 16** on the tray.

FIGS. 24 through 29 show an example of a wiper assembly. In this example the wiper comprises a chassis 73, and a wiper blade 74 (**74*a* shows sections of blade engaging and protruding through the chassis) that has fingers 75. In this example the fingers are designed to cooperate with the lowered surfaces of the guides 16 in the dispenser. In this example the blade is made of SANTOPRENE® and the chassis is made of polypropylene. This embodiment contains raised or thicker areas 97 of the wiper. These raised areas cooperate with the guides 16 on the tray. This example also includes rounded ridges 96, similar in structure and function to those described in FIG. 32** below.

Wiper blades can be made out of any flexible or resilient material, such as thermoplastic elastomers, foam, sponge, plastic, or rubber having a Shore A durometer hardness value ranging from about 0 to 80 (as determined according to ASTM D 2240). In combination with the other teachings herein, the applicants have discovered that a dispensing characteristic is attributable to the hardness of the wiper blade. As such, this characteristic in combination with one or more of the others can enhance the dispensing of a roll of wet wipes. Thus, the following ranges for the wiper blade hardness, in Shore A durometer, can be advantageous towards enhancing the dispensing of a roll of wet wipes from a dispenser, e.g., the dispensers disclosed herein as well as any others that could be similar in certain regards, in order of increasing preference: the wiper blade has a Shore A hardness equal to or less than about 80 durometer, equal to or less than about 70 durometer, equal to or less than about 60 durometer, equal to or less than about 50 durometer, equal to or less than about 45 durometer, equal to or less than about 40 durometer, or equal to or less than about 30 durometer. Also, the wiper blade preferably has a Shore A hardness which can be any of these and also preferably is no less than about 25 durometer.

It is further preferred that the wiper blades be made from a material that will form a good moisture and contamination barrier. Examples of preferred types of material are SANTOPRENE®, Kraton®, silicone, or styrene ethylene/butylene styrene (SEBS). The wiper blade is designed to function with the guides and the tray and to a limited extent the lip of the cartridge. Depending on the placement of the wiper, it could have greater or lesser interaction with these components of the dispensing system. The gap between the end of the wiper blade and the tray may be varied depending upon the thickness of the wet wipes and how much drag is need for the dispensing system to function as desired. The wiper blade can help to hold the tail of the wipe in place and thus keep the tail from falling back through the gap and into the cartridge.

The wiper blade can have various physical properties. For example, the material can have a Gurley stiffness value (ASTM D 6125-97) between about 100 mg and 8000 mg, preferably between about 200 mg and 6000 mg, and more preferably between about 400 mg and 3000 mg. The wiper blade can have a tensile strength (ASTM D 412) between about 100 psi and about 1000 psi and more preferably between about 400 psi and about 700 psi. The wiper blade can have a tear strength (ASTM D 624) between about 30 pli and about 300 pli and more preferably between about 50 pli and about 150 pli. The wiper blade can have compression set (ASTM 395 B) between about 5% and about 30% (room temperature) and more preferably between about 10% and about 25% (room temperature), and 10% to 100% (at 70° C.) and more preferably between about 20% and about 50% (at 70° C.). The wiper blade can have a specific gravity (ASTM D 792) between about 0.70 g/cc and 1.40 g/cc and more preferably between about 0.85 g/cc and 1.20 g/cc. The wiper blade can also be designed to exert force onto a wipe across substantially the entire length of the wiper blade at least during dispensing, and even some force not during dispensing to assist in better sealing the chamber with wipes therein from the environment outside the chamber. The wiper blade can have 1/16% to 1% of Kemamide™ wax that can bloom to the surface during use to lower the initial coefficient of friction between the wiper blade and the wipes during dispensing. Such an available material for making a wiper blade having these various properties is know as DynaFlex™ G 2755 sold by GLS Corporation of McHenry, Ill., USA.

The force applied to the wipe by the wiper blade when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

FIGS. 30 to 32 illustrate dispensers 1 that have a rounded member 95 or rounded ridges 96. These components are shown as being part of or attached to the wiper blade assembly 99 and adjacent the wiper blade 74. These components prevent or reduce the tendency of the roll from binding in the gap as the size of the roll decreases.

FIG. 33 illustrates a conventional holder 85 with the roller removed and a mounting assembly 8 engaged with the post 86. In actual use the mounting assembly would be joined with a dispenser, as shown for example in FIG. 2, and the dispenser would thereby be mounted to the holder 85. Alternative mountings may also be employed. These mountings may be fixed or removable. They may include by way of example such fastening systems as cable ties, wing nuts, anchor bolts, click and grooves and snap and lock mechanisms.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A system for dispensing a plurality of perforated wipes having a perforation detach strength characteristic, comprising:

a dispenser having a dispensing force characteristic and including a sealable chamber, the chamber configured to retain the plurality of perforated wipes therein;

a dispensing opening in communication with the chamber, the opening adapted to dispense wipes from the plurality of perforated wipes through the opening and out of the dispenser;

a wiper blade having a Shore A hardness equal to or less than about 80 durometer positioned in the dispenser to engage at least a portion of the wipes as the wipes dispense through the opening; and wherein a ratio of the perforation detach strength characteristic to the dispensing force characteristic is greater than 1:1.

2. The system of claim 1 wherein the ratio is equal to or greater than about 1.5:1.

3. The system of claim 1 wherein the ratio is equal to or greater than about 2:1.

4. The system of claim 1 wherein the ratio is equal to or greater than about 2.5:1.

5. The system of claim 1 wherein the ratio is equal to or greater than about 3:1.

6. The system of claim 5 wherein the wiper blade has a Shore A hardness no less than about 25 durometer.

7. The system of claim 5 wherein the plurality of perforated wipes comprises a solid coreless roll.

8. The system of claim 1 wherein the ratio is equal to or greater than about 4:1.

9. The system of claim 1 wherein the ratio is equal to or greater than about 5:1.

10. The system of claim 1 wherein the ratio is equal to or greater than about 6:1.

11. The system of claim 1 wherein the ratio is equal to or greater Than about 7:1.

12. The system of claim 1 wherein the wiper blade has a Shore A hardness equal to or less than about 60 durometer.

13. The system of claim 1 wherein the wiper blade has a Shore A hardness equal to or less than about 50 durometer.

14. The system of claim 1 wherein the wiper blade has a Shore A hardness between about 40 durometer and about 25 durometer.

15. The system of claim 14 wherein the plurality of perforated wipes comprises a solid coreless roll.

16. The system of claim 1 wherein the wiper blade has a Shore A hardness no less than about 25 durometer.

17. The system of claim 1 wherein the plurality of perforated wipes comprises a solid coreless roll.

18. A roll of wipes dispensing system, comprising:

a roll of perforated wipes having a perforation detach strength characteristic;

a dispenser having a dispensing force characteristic and including a sealable chamber, the roll of perforated wipes retained within the chamber;

a dispensing opening in communication with the chamber, the opening adapted to dispense wipes from the roll of perforated wipes through the opening and out of the dispenser;

a resilient wiper blade having a Shore A hardness equal to or less than about 80 durometer positioned in the dispenser to engage at least a portion of the wipes as the wipes dispense through the opening; and wherein a ratio of the perforation detach strength characteristic to the dispensing force characteristic is greater than 1:1.

19. The system of claim 18 wherein the ratio is greater than 1:1 and equal to or less than about 7:1.

20. The system of claim 19 wherein the ratio is equal to or greater than about 3:1.

21. The system of claim 20 wherein the roll of perforated wipes comprises a solid coreless roll.

22. The system of claim 18 wherein the perforation detach strength characteristic is greater than 55 g/cm.

23. The system of claims 18 wherein the perforation detach strength characteristic is greater than about 60 g/cm and less than about 150 g/cm.

24. The system of claim 18 wherein the wiper blade has a Shore A hardness between about 30 durometer and about 70 durometer.

25. The system of claim 24 wherein the roll of perforated wipes comprises a solid coreless roll.

26. The system of claim 18 wherein the roll of perforated wipes comprises a solid coreless roll.

* * * * *